US006473063B1

(12) United States Patent
Suzuki et al.

(10) Patent No.: US 6,473,063 B1
(45) **Date of Patent: *Oct. 29, 2002**

(54) ELECTRON SOURCE, IMAGE-FORMING APPARATUS COMPRISING THE SAME AND METHOD OF DRIVING SUCH AN IMAGE-FORMING APPARATUS

(75) Inventors: Hidetoshi Suzuki, Fujisawa; Ichiro Nomura; Toshihiko Takeda, both of Atsugi; Naoto Nakamura, Isehara; Yasuhiro Hamamoto, Machida, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/653,903

(22) Filed: May 28, 1996

(30) Foreign Application Priority Data

May 30, 1995 (JP) ..... 7-154063

(51) Int. Cl.[7] ..... G09G 3/22
(52) U.S. Cl. ..... 345/74.1
(58) Field of Search ..... 345/74, 75, 76, 345/80; 313/309, 310; 315/169.1, 169.3

(56) References Cited

U.S. PATENT DOCUMENTS 5,023,110 A 6/1991 Nomura et al. ..... 427/49
5,066,883 A * 11/1991 Yoshioka et al. ..... 313/309
5,593,335 A 1/1997 Suzuki et al. ..... 445/50
5,654,607 A * 8/1997 Yamaguchi et al. ..... 313/495
5,659,329 A * 8/1997 Yamanobe et al. ..... 345/74
5,828,352 A * 10/1998 Nomura et al. ..... 345/74
5,838,097 A * 11/1998 Kasanuki et al. ..... 313/495
5,986,389 A * 11/1999 Tsukamoto ..... 313/310

FOREIGN PATENT DOCUMENTS

| | | |
|---|---|---|
| EP | 0536732 | 4/1993 |
| JP | 62186649 | 2/1989 |
| JP | 4-359796 | 12/1992 |
| JP | 4-361355 | 12/1992 |
| JP | 5-001224 | 1/1993 |
| JP | 5-077897 | 4/1993 |
| JP | 5-078165 | 4/1993 |
| JP | 5-279364 | 11/1993 |
| JP | 5-282421 | 11/1993 |
| JP | 6-273606 | 11/1994 |
| JP | 06-342636 | 12/1994 |
| JP | 7-134559 | 5/1995 |
| JP | 7-134561 | 5/1995 |
| JP | 8-138583 | 5/1996 |

* cited by examiner

*Primary Examiner*—Richard Hjerpe
*Assistant Examiner*—Ronald Laneau
(74) *Attorney, Agent, or Firm*—Fitzpatrick, Cella, Harper & Scinto

(57) ABSTRACT

An electron source comprises a plurality of electron-emitting devices and a drive means for driving the devices. The drive means applies a voltage above a threshold level to selected ones of the plurality of electron-emitting devices according to an image signal to cause the selected devices to emit electrons. The drive means also applies a voltage pulse for bringing the plurality of electron-emitting devices into a high resistance state. The voltage pulse for bringing into a high resistance state has a polarity reverse to that of the voltage for causing electron emission and has a voltage rising rate of greater than 10V/sec.

25 Claims, 20 Drawing Sheets

ELECTRON SOURCE, IMAGE-FORMING APPARATUS COMPRISING THE SAME AND METHOD OF DRIVING SUCH AN IMAGE-FORMING APPARATUS

BACKGROUND OF THE INVENTION

1. Field of the Invention

This invention relates to an electron source comprising a large number of electron-emitting devices arranged in a matrix array, an image-forming apparatus comprising such an electron source and a method of driving such an image-forming apparatus.

2. Related Background Art

In recent years, there have been a number of studies on cold cathode type electron-emitting devices, trying to use them for image-forming apparatuses. A surface conduction electron-emitting device is a cold cathode type electron-emitting device. A surface conduction electron-emitting device is realized by utilizing the phenomenon that electrons are emitted out of a small thin film formed on a substrate when an electric current is forced to flow in parallel with the film surface.

A surface conduction electron-emitting device typically comprises an electrically insulating substrate, a pair of device electrodes arranged on the substrate and an electroconductive thin film containing an electron emitting region and arranged between the device electrodes to electrically connect them. The electron emitting region is produced by subjecting the electroconductive thin film, which is typically made of a metal oxide, to a current conduction treatment referred to as energization forming. In an energization forming process, a constant DC voltage or a slowly rising DC voltage that rises typically at a rate of 1V/min. is applied to given opposite ends of the electroconductive thin film to partly destroy, deform or transform the film and produce an electron-emitting region which is electrically highly resistive. When a voltage is applied to an electroconductive thin film where such an electron emitting region is formed in order to make an electric current flow therethrough, the electron emitting region starts emitting electrons.

A surface conduction electron-emitting device having a configuration as described above is advantageous in that it is structurally simple and can be manufactured easily so that a large number of such devices can be arranged over a large area in a simple manner at low cost. Studies have been made to exploit this advantage, and known applications of such devices include image-forming apparatuses including display apparatuses.

The performance of a surface conduction electron-emitting device will be described below by referring to FIG. 19 of the accompanying drawings.

The electric current (If) that flows through a surface conduction electron-emitting device when a voltage (Vf) is applied thereto cannot be uniquely defined. A surface conduction electron-emitting device may operate typically in either of two different ways. Firstly, the electric current flowing through the device (If) may increase in the initial stages as the applied voltage (Vf) is raised from 0[V] but falls thereafter before it gets to a plateau that may be slightly inclined upward. Alternatively, the electric current flowing through the device (If) may monotonically increase as the applied voltage (Vf) is raised from 0[V].

For the sake of convenience, hereinafter, the first characteristic of performance will be referred to as the static characteristic, whereas the second one will be referred to as the dynamic characteristic.

In FIG. 19, the broken line indicates the static characteristic that appears when a voltage sweep speed of less than about 1V/min. is used. More specifically, in the first voltage region of Vf=0 to V1 (I region), the electric current flowing through the device (If) monotonically increases with the increase of the voltage (Vf). In the succeeding voltage region of Vf=V1 to V2 (II region), the electric current flowing through the device (If) decreases with the increase of the voltage (Vf). This characteristic is referred to as a voltage-controlled-negative-resistance characteristic (hereinafter referred to as a "VCNR characteristic" hereinafter). In the third voltage region of Vf=V2 to Vd (III region), the electric current flowing through the device (If) practically does not change relative to the increase of the voltage (Vf). Note that V1 represents the voltage when the electric current flowing through the device (If) is maximized and V2 represents the voltage corresponding to the Vf axis intercept of the tangent line to the If curve at the maximum gradient point in the If decreasing resion (II region). Meanwhile, the emission current (Ie) of the device increases as the voltage (Vf) is raised with regard to a threshold voltage Ve.

In FIG. 19, the solid line indicates the dynamic characteristic of the device when the voltage sweep speed is greater than about 10V/sec. More specifically, if the maximum voltage is swept with Vd (If (Vd) line in FIG. 19), the electric current flowing through the device (If) gradually increases and its line comes to agree with the If line for the static characteristic at Vd. If, on the other hand, the maximum voltage is swept with V2 (If (V2) line in FIG. 19), the line of the electric current flowing through the device (If) also gradually increases and its line comes to agree with the If line for the static characteristic at V2. If the maximum voltage is swept with a voltage of the I region, electric current flowing through the device (If) changes substantially along the If line.

While the above described static and dynamic characteristics for the I–V relationship can be varied by changing the material, the profile and/or the other factors of the device or depending on the vacuum atmosphere, a surface conduction electron-emitting device that operates in a desired way typically shows the above three regions, or the regions I through III, of performance.

Different electron sources comprising a large number of surface conduction electron-emitting devices arranged in the form of X-Y matrix have been proposed in order to exploit the above described characteristics for flat panel CRTs and other displays.

A matrix type electron source is realized by arranging M×N surface conduction electron-emitting devices and electrically connecting them by wires XE1 through XEN and YE1 through YEM as illustrated in FIG. of the accompanying drawings. When such an electron source is used for an image-forming apparatus, e.g. a flat panel CRT, the pixels on the screen and the surface conduction electron-emitting devices are arranged on a one-to-one correspondence basis and the latter are driven to operate according to a given pattern.

Two drive modes are known to date; point-by-point sequential scanning for exciting the screen on a pixel by pixel basis and line-by-line sequential scanning for exciting the screen on a pixel line by pixel line basis. (Each line has M pixels in the arrangement of FIG. 20.) The line-by-line sequential scanning system is normally used as it is advantageous particularly from the viewpoint of the speed of driving each surface conduction electron-emitting device and the momentary current generated by the emitted electron beam because a longer operating time is allocated to each pixel.

Meanwhile, these known scanning systems are accompanied by a problem of high power consumption rate because a large electric current is made to flow to those surface conduction electron-emitting devices that are not currently emitting electron beams and hence staying idle when a large number of surface conduction electron-emitting device are driven either by line-by-line sequential scanning or by point-by-point sequential scanning.

This problem will be discussed below in greater detail by referring to FIGS. 21 through 23 of the accompanying drawings.

FIG. 21 is a schematic plan view of an electron source that comprises only 6×6 surface conduction electron-emitting devices arranged in a simple matrix arrangement for the sake of simplicity. The surface conduction electron-emitting devices are denoted by D(1,1), D(1,2), . . . , D(6,6), using the popular (x,y) coordinate system. If such an electron source is used for a flat panel CRT and each surface conduction electron-emitting device is required to emit an electron beam with a current intensity of $1\times10^{-6}$ A in order to produce a brightness necessary for image display operation, 14V is applied to each of the surface conduction electron-emitting devices that corresponds to a pixel that is emitting light, whereas Vth=10V or less is applied to each of the surface conduction electron-emitting devices that corresponds to a pixel that is not emitting light because of the performance of the surface conduction electron-emitting device shown in FIG. 19.

In order to produce an image on a line-by-line sequential scanning basis, the six device rows running in parallel with the x-axis are sequentially scanned by applying 0V to a row selected out of the six rows of XE1 through XE6 and 7V to the remaining rows that are not selected.

Now, in order to cause any of the surface conduction electron-emitting devices of the selected device row to emit an electron beam with a current intensity of 1 $\mu$A, 14V is applied to the wire for feeding the surface conduction electron-emitting device out of the wires YE1 through YE6 and 7V is applied to the remaining wires.

For example, for displaying an image illustrated in FIG. 22, 0V is applied to XE1 and 7V is applied to XE2 through XE6 while 7V is applied to YE1, YE5 and YE6 and 14V is applied to YE2 through YE4 in order to drive the first row. Similarly, 0V is applied to XE2 and 7V is applied to XE1 and XE3 through XE6, while 7V is applied to YE1 and YE3 through YE6 and 14V is applied to YE2 in order to drive the second row. Then, the third through sixth rows are sequentially scanned to produce the image. This operation is summarized in Table 1 below.

TABLE 1

| scanned line (driven row) | applied voltage (V) | | | | | |
|---|---|---|---|---|---|---|
| | XE1 | XE2 | XE3 | XE4 | XE5 | XE6 |
| (1) first row | 0 | 7 | 7 | 7 | 7 | 7 |
| (2) second row | 7 | 0 | 7 | 7 | 7 | 7 |
| (3) third row | 7 | 7 | 0 | 7 | 7 | 7 |
| (4) forth row | 7 | 7 | 7 | 0 | 7 | 7 |
| (5) fifth row | 7 | 7 | 7 | 7 | 0 | 7 |
| (6) sixth row | 7 | 7 | 7 | 7 | 7 | 0 |

TABLE 1-continued

| scanned line (driven row) | applied voltage (V) | | | | | |
|---|---|---|---|---|---|---|
| | YE1 | YE2 | YE3 | YE4 | YE5 | YE6 |
| (1) first row | 7 | 14 | 14 | 14 | 7 | 7 |
| (2) second row | 7 | 14 | 7 | 7 | 7 | 7 |
| (3) third row | 7 | 14 | 14 | 14 | 7 | 7 |
| (4) forth row | 7 | 14 | 7 | 7 | 7 | 7 |
| (5) fifth row | 7 | 14 | 7 | 7 | 7 | 7 |
| (6) sixth row | 7 | 7 | 7 | 7 | 7 | 7 |

Operations (1) through (6) are sequentially carried out.

With the above drive technique, the surface conduction electron-emitting devices of the unselected rows (unselected devices) may be subjected to a voltage difference of 7V to consequently raise the power consumption rate. Assume that an image of FIG. 22 is being currently displayed and the third device row is being driven, 14V is applied to the opposite terminals of each of the devices at D(2,3), D(3,3) and D(4,3), which by turn emit an electron beam, whereas 14V−7V=7V is applied to the opposite terminals of each of the devices connected to wires YE2, YE3 or YE4 except those on the third row as shown in FIG. 23. As a result, an electric current of 2.5 mA flows through each of the 15 devices of the unselected row at the cost of large power consumption. Thus, it is clear from this example that, when 14V is applied to a surface conduction electron-emitting device, 7V is inevitably applied to each of the surface conduction electron-emitting devices that are commonly wired with that device. While the above electron source comprises only 6×6 surface conduction electron-emitting devices arranged in the form of a matrix for the sake of simplicity, the rate of inutile power consumption will rise enormously in an image-forming apparatus comprising as many as 1,000×1,000 surface conduction electron-emitting devices. Since the power source, the drive circuit and the wires of such an image-forming apparatus have to be selected by taking this large inutile power consumption rate into consideration, the overall cost of such an apparatus can become prohibitive.

SUMMARY OF THE INVENTION

In view of the above identified problem, it is therefore an object of the present invention to provide an electron source that can significantly reduce the inutile power consumption of unselected surface conduction electron-emitting devices and, at the same time, effectively avoid unnecessary electron emission that can adversely affect the image forming operation of the electron source. Another object of the invention is provide an image-forming apparatus comprising such an electron source as well as a method of driving such an image-forming apparatus.

According to the invention, the above objects are achieved by providing an electron source comprising a plurality of electron-emitting devices having a pair of electrodes and an electroconductive thin film disposed between the electrodes and containing an electron emitting region and a drive means for driving said plurality of electron-emitting devices, in which:

said drive means applies a voltage above a threshold level to the electrodes of selected ones of said plurality of electron-emitting devices according to an image signal to cause the selected electron-emitting devices to emit electrons and also a voltage pulse for moving said plurality of electron-emitting devices into a high resistance state, said voltage pulse having a polarity reverse to that of the voltage for causing electron emission and a voltage rising (to zero volt) rate (or a falling rate if the absolute value of the voltage is concerned) of greater than 10V/sec.

According to another aspect of the invention, there is provided an image-forming apparatus comprising a plurality of electron-emitting devices having a pair of electrodes and an electroconductive thin film disposed between the electrodes and containing an electron emitting region, a drive means for driving said plurality of electron-emitting devices and an image-forming member, in which:

said drive means applies a voltage above a threshold level to the electrodes of selected ones of said plurality of electron-emitting devices according to an image signal to cause the selected electron-emitting devices to emit electrons and also a voltage pulse for bringing said plurality of electron-emitting devices into a high resistance state, said voltage pulse having a polarity reverse to that of the voltage for causing electron emission and a voltage rising (to zero volt) rate of greater than 10V/sec.

DETAILED DESCRIPTION OF THE PREFERRED EMBODIMENTS

With an electron source according to the invention and comprising surface conduction electron-emitting devices, the electron-emitting devices are brought into a high resistance state in their electric current-voltage relationship by applying a predetermined voltage pulse thereto in order to significantly reduce the inutile electric current running through the unselected ones of the surface conduction electron-emitting devices.

Figure 19:
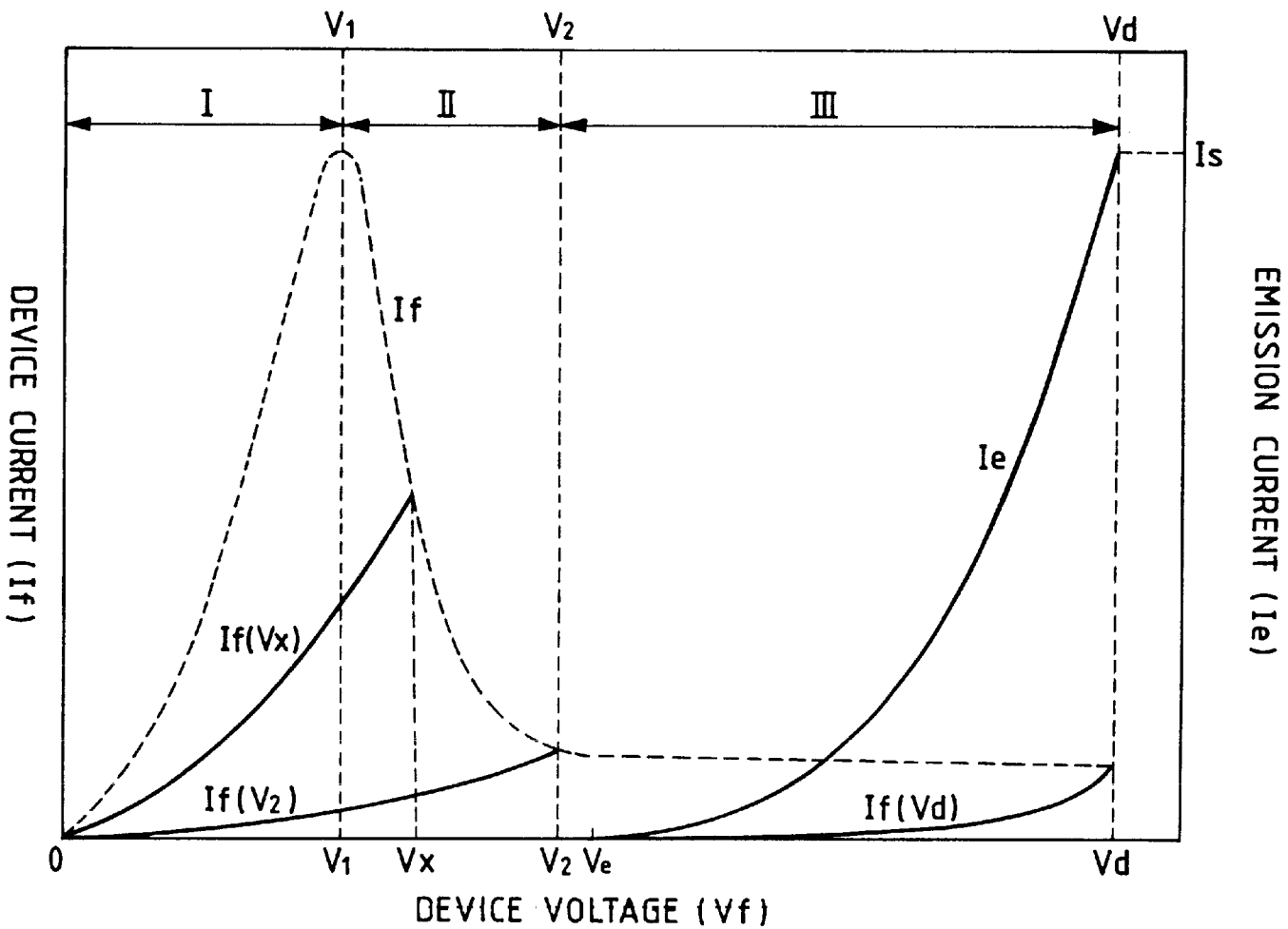
FIG. 19 PRIOR ART
FIG. 19 is a graph showing the performance of a known surface conduction electron-emitting device.
Figure 20:
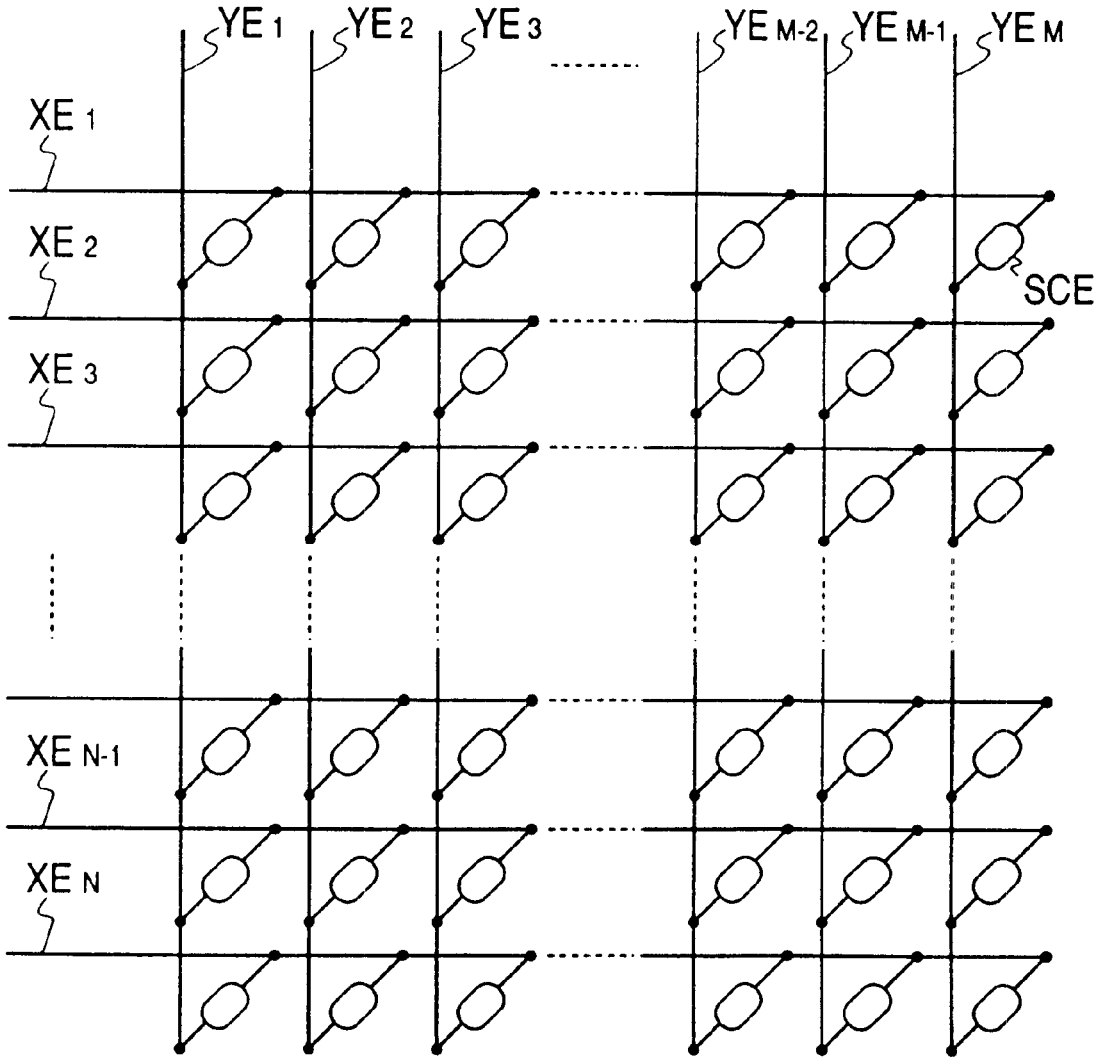
FIG. 20 PRIOR ART
FIG. 20 is a schematic view of a known electron source comprising electron-emitting devices arranged in a M×N matrix arrangement.
Figure 21:
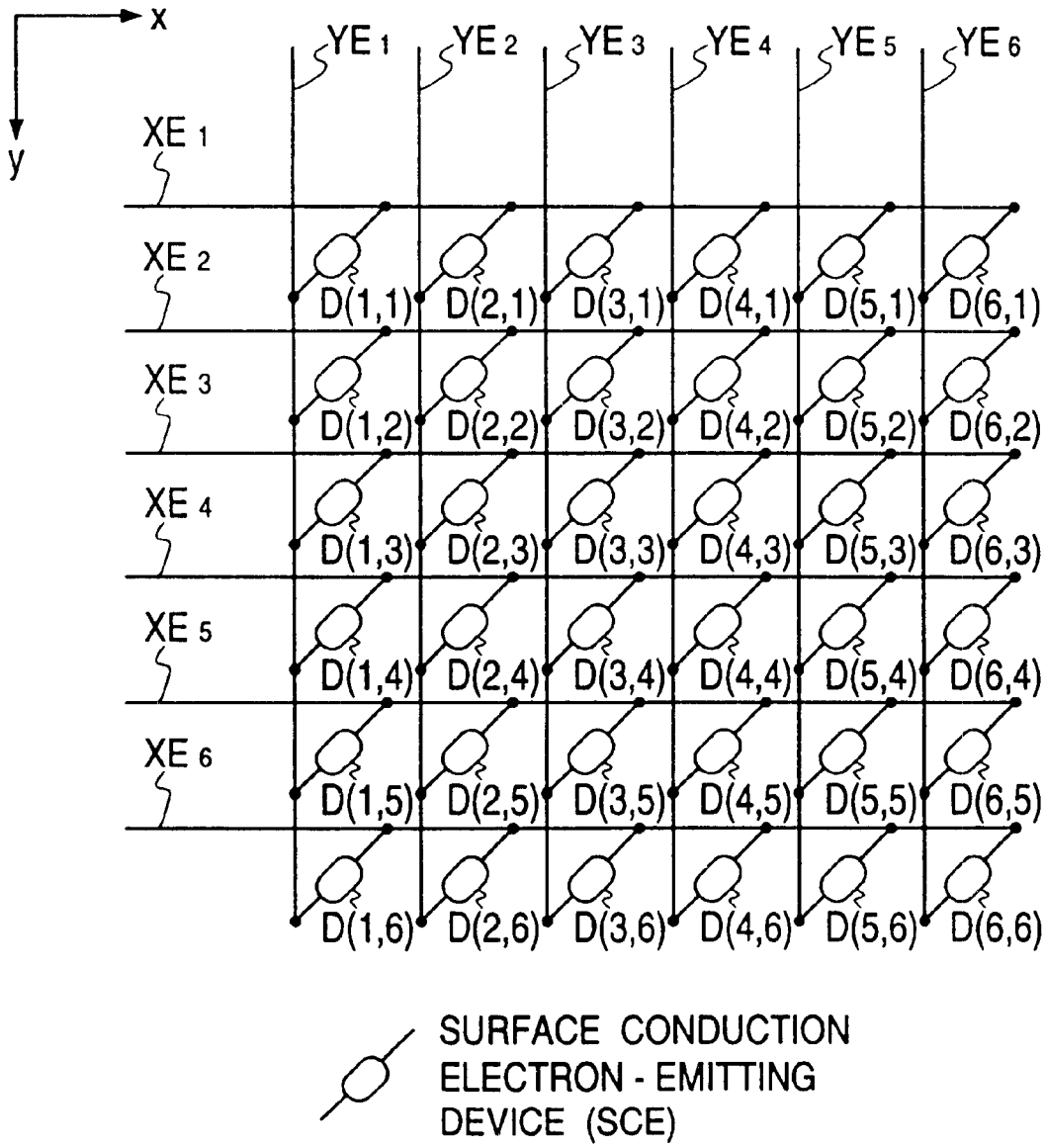
FIG. 21 PRIOR ART
FIG. 21 is a schematic view of a known electron source comprising electron-emitting devices arranged in a 6×6 matrix arrangement.
Figure 22:
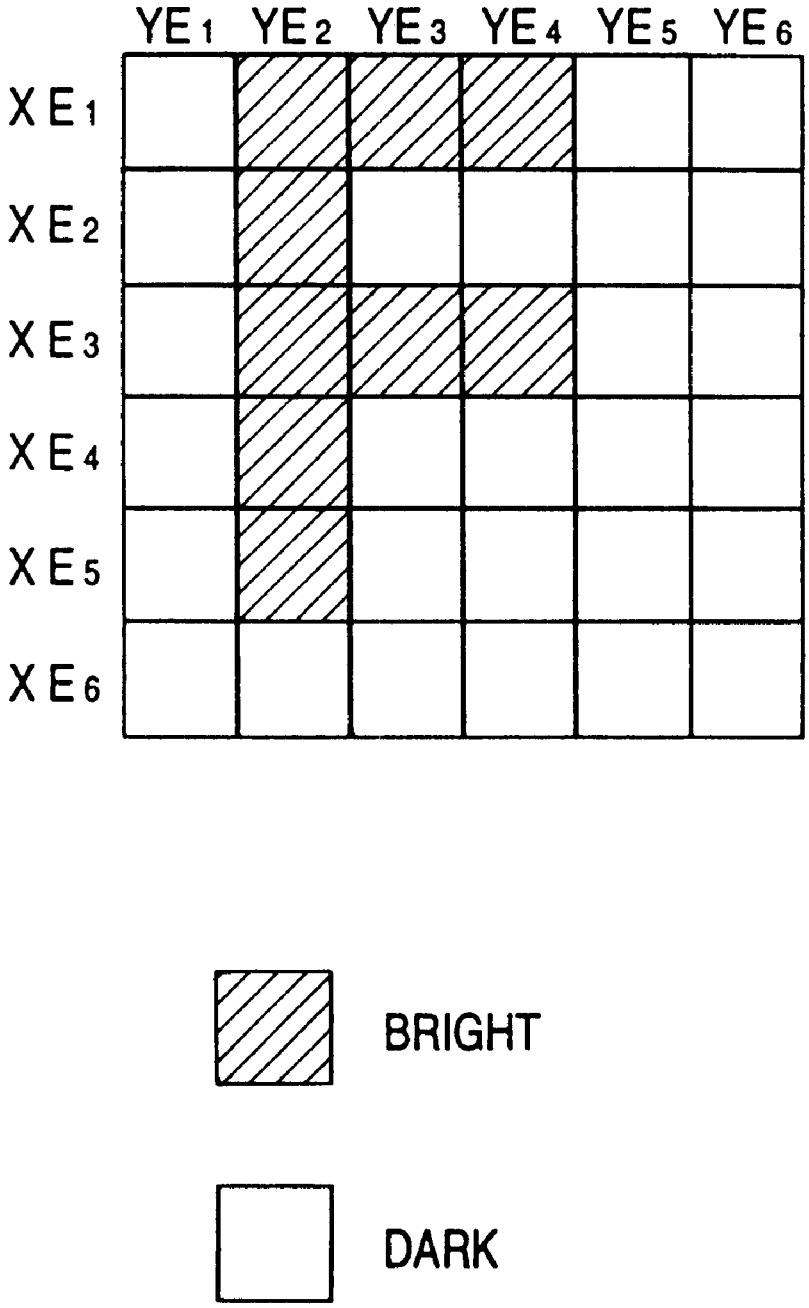
FIG. 22 PRIOR ART
FIG. 22 is a schematic view of an image to be displayed by a known image-forming apparatus.
Figure 23:
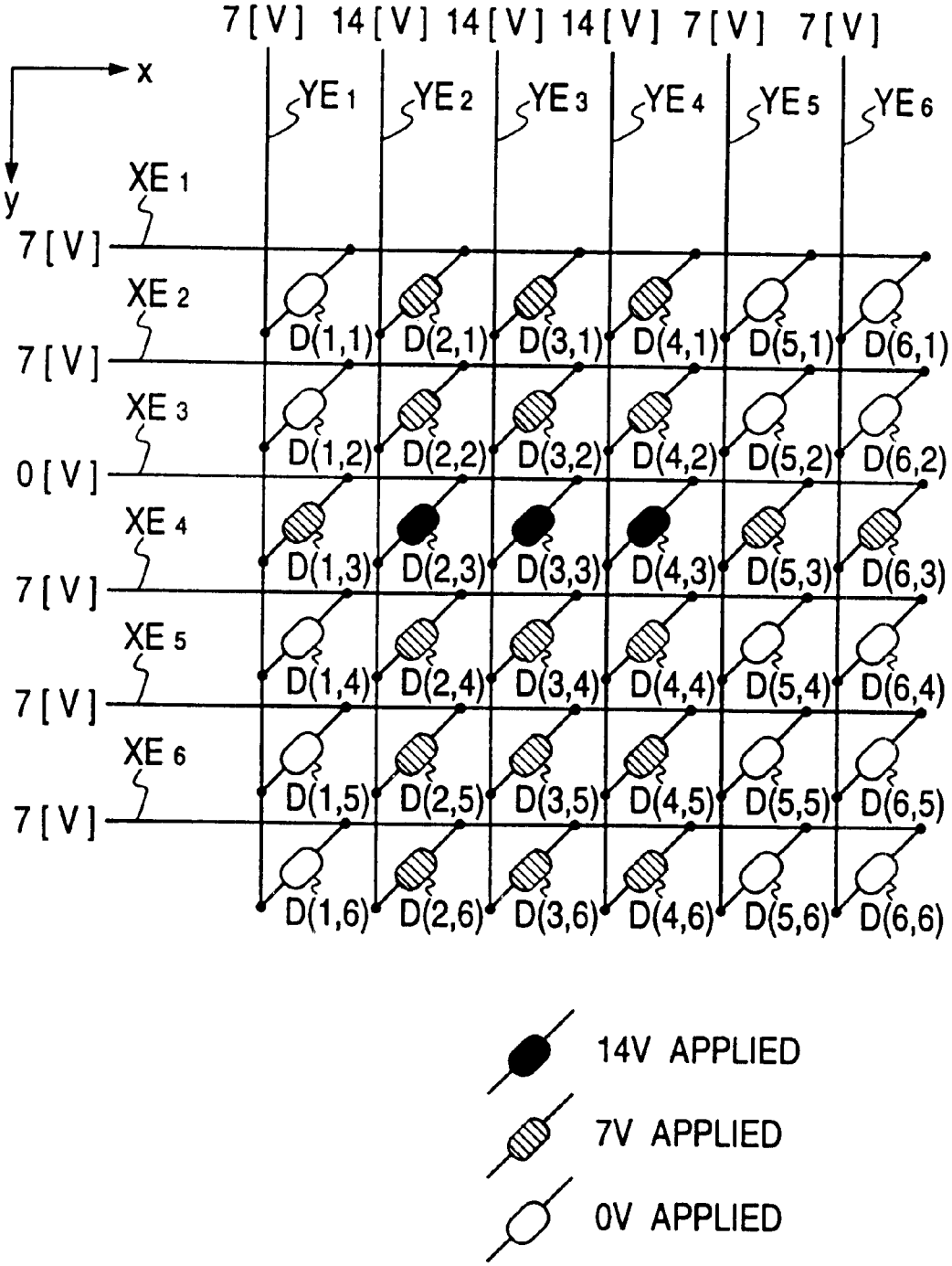
FIG. 23 PRIOR ART
FIG. 23 is a schematic view of a known electron source comprising electron-emitting devices with a 6×6 matrix arrangement, illustrating what voltages are applied thereto.

More specifically, when a voltage pulse with a voltage rising (to zero volt) rate of greater than 10V/sec. is applied to a surface conduction electron-emitting device, the device is brought into a high resistance state, leaving the I–V relationship of the static characteristic with three regions of I through III shown in FIG. 19. For the purpose of the invention, a high resistance state refers to a state where the device behaves to show the current-voltage relationship of the dynamic characteristic. For example, once a voltage pulse with a wave height of Vd and a voltage rising (to zero volt) rate of greater than 10V/sec. is applied to a surface conduction electron-emitting device showing the I–V relationship of FIG. 19, the device is brought to a high resistance state indicated by If (Vd) in FIG. 19. After the device has moved to the high resistance state, it can provide an emission current of Is when a voltage Vd is applied thereto and, additionally, the electric current flowing through the device (If) is greatly reduced if a voltage less than Ve is applied to the device as clearly seen by comparing the solid line of If (Vd) and the broken line representing the static characteristic of the device.

After the device is brought into a high resistance state by applying a voltage pulse, it remains in that state for a limited period of time but then restores the I–V relationship of the static characteristic indicated by the broken line in FIG. 19. Thus, the device can be held to the high resistance state for any desired period of time by applying such a voltage pulse repeatedly.

The present invention is based on the finding that a surface conduction electron-emitting device shows the I–V relationship of the static characteristic and is brought to a high resistance state even if the applied voltage pulse has a polarity reverse to that of the voltage applied for driving device.

According to the invention, in an electron source comprising a plurality of surface conduction electron-emitting devices showing the above described I–V relationship of the static characteristic or an image-forming apparatus comprising such an electron source, each of the devices is brought into a state showing a different I–V relationship by applying a voltage pulse having a polarity reverse to that of the drive voltage and a voltage rising (to zero volt) rate of greater than 10V/sec. (hereinafter referred to as a "high resistance realizing pulse"). Thus, the inutile electric current running through each of the unselected devices is reduced by bringing it into a high resistance state to greatly reduce the power consumption of the entire apparatus in operation. The practical upper limit of the falling voltage rate of the high resistance realizing pulse is $10^{10}$[V/sec.].

The high resistance realizing pulse that characterized the present invention may be triangular, rectangular or sinusoidal. Preferably, the high resistance realizing pulse has a wave height greater than Vc in the II region (VCNR region) of FIG. 10. More preferably, it is a voltage pulse showing a wave height greater than the voltage applied to the unselected devices of the electron source comprising a plurality of electron-emitting devices arranged in a simple matrix and having a polarity reverse to that of the voltage for driving the devices.

Additionally, an image-forming apparatus according to the invention is so devised that the contrast of the produced image is not deteriorated when such a high resistance realizing pulse is applied to the electron-emitting devices.

Firstly, any deterioration in the contract of the image that may be given rise to by electron beams emitted due to a high resistance realizing pulse can be prevented by arranging the picture elements of the image-forming member (targets) precisely in designed respective positions, where they are not hit by electron beams emitted, if ever, due to a high resistance realizing pulse.

Secondly, the electrodes of each of the surface conduction electron-emitting devices are so devised that they produce an electric field under the effect of which, any electron beams emitted due to a high resistance realizing pulse are caught by the device electrodes and do not get to any of the picture elements of the image-forming member (targets). More specifically, in each of the surface conduction electron-emitting devices, the top surface of the device electrode that operates as a positive electrode for forming an image (or as a negative electrode for applying a high resistance realizing pulse) is made lower than that of the device electrode that operates as a negative electrode (or as a positive electrode for applying a high resistance realizing pulse).

Now, a surface conduction electron-emitting device that can be used for an electron source and hence for an image-forming apparatus according to the invention will be described below.

A surface conduction electron-emitting device according to the invention may be either of a plane type or of a step type. Firstly, a surface conduction electron-emitting device of a plane type will be described.

Figure 1A:
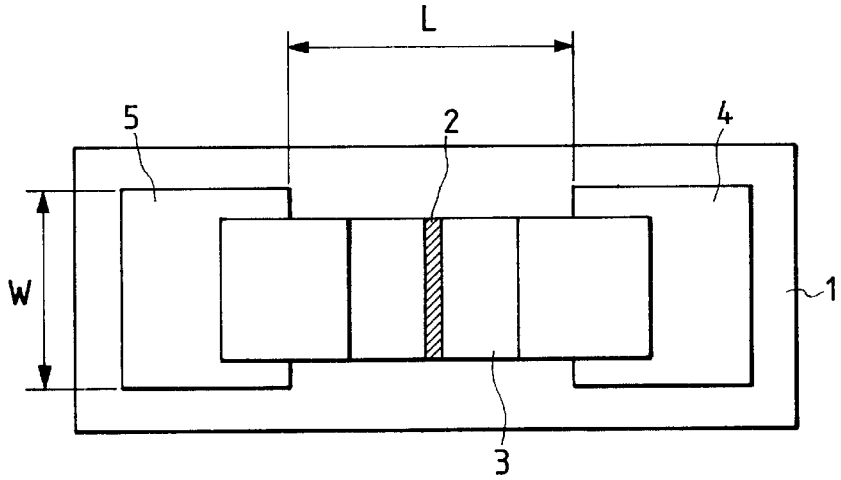
FIGS. 1A and 1B are schematic views of a plane type surface conduction electron-emitting device that can be used for the purpose of the invention.
Figure 1B:
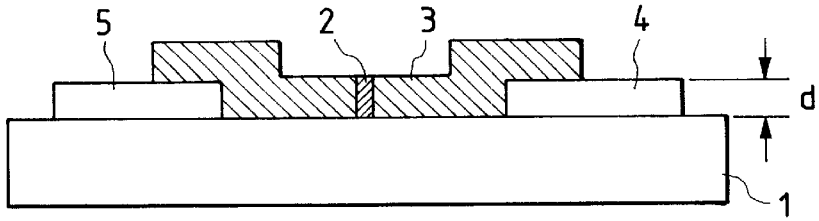

FIGS. 1A and 1B are schematic views of a plane type surface conduction electron-emitting device, showing its basic configuration.

Referring to FIGS. 1A and 1B, it comprises a substrate 1, an electron emitting region 2, an electroconductive thin film 3 and a pair of device electrodes 4 and 5.

Materials that can be used for the substrate 1 include quartz glass, glass containing impurities such as Na to a reduced concentration level, soda lime glass, multilayer structures realized by forming an $SiO_2$ layer on soda lime glass by means of sputtering, ceramic substances such as alumina as well as Si.

While the oppositely arranged device electrodes 4 and 5 may be made of any highly conducting material, preferred candidate materials include metals such as Ni, Cr, Au, Mo, W, Pt, Ti, Al, Cu and Pd and their alloys, printable conducting materials made of a metal or a metal oxide selected from Pd, Ag, $RuO_2$, Pd—Ag and glass, transparent conducting materials such as $In_2O_3$—$SnO_2$ and semiconductor materials such as polysilicon.

The distance L separating the device electrodes, the length W of the device electrodes, the contour of the electroconductive thin film 3 and other factors of the surface conduction electron-emitting device may be determined depending on the application of the device. The distance L separating the device electrodes is preferably between hundreds angstroms and hundreds micrometers and, still preferably, between several micrometers and tens of several micrometers depending on the voltage to be applied to the device electrodes and other considerations.

The length W of the device electrodes is preferably between several micrometers and hundreds of several micrometers depending on the resistance of the electrodes and the electron-emitting characteristics of the device. The film thickness d of the device electrodes is between hundreds angstroms and several micrometers.

A surface conduction electron-emitting device illustrated in FIGS. 1A and 1B is prepared by sequentially laying device electrodes 4 and 5 and an electroconductive thin film 3 on a substrate 1, it may alternatively be prepared by sequentially laying an electroconductive thin film 3 and oppositely disposed device electrodes 4 and 5 on a substrate 1.

The electroconductive thin film 3 is preferably a fine particle film in order to provide excellent electron-emitting characteristics. The thickness of the electroconductive thin film 3 is determined as a function of the stepped coverage of the electroconductive thin film on the device electrodes 4 and 5, the electric resistance between the device electrodes 4 and 5 and the parameters for the energization forming operation as well as other factors and preferably between several angstroms and thousands of several angstroms and more preferably between ten and 500 angstroms. The electroconductive thin film 3 normally shows a sheet resistance Rs between $10^3$ and $10^7$ Ω/□.

The electroconductive thin film 3 is made of fine particles of a material selected from metals such as Pd, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such TiC, ZrC, HfC, TaC, SiC and WC, nitrides such as TiN, ZrN and HfN, semiconductors such as Si and Ge and carbon.

The term a "fine particle film" as used herein refers to a thin film constituted of a large number of fine particles that may be loosely dispersed, tightly arranged or mutually and randomly overlapping (to form an island structure under certain conditions). The diameter of fine particles to be used for the purpose of the present invention is preferably between several angstroms and thousands of several angstroms and more preferably between ten and 200 angstroms.

The electron-emitting region 2 is formed in part of the electroconductive thin film 3 and comprises a fissure and its peripheral areas. Electrons are emitted from the fissure and its peripheral areas. The performance of the electron emitting region 2 is dependent on the thickness, the quality and the material of the electroconductive thin film 3 and conditions under which the energization forming process is carried out. Therefore, the electron emitting region 2 is not particularly limited to the one shown in FIGS. 1A and 1B in terms of position and shape.

The fissure may be provided with electroconductive fine particles with a diameter between several and hundreds of several angstroms. The electroconductive fine particles contain elements that are partly or wholly common with the material of the electroconductive thin film 3. The electron emitting region 2 and part of the electroconductive thin film 3 located close to the electron emitting region 2 may contain carbon and/or carbon compounds.

Now, the basic configuration of a step type surface conduction electron-emitting device will be described below.

Figure 2:
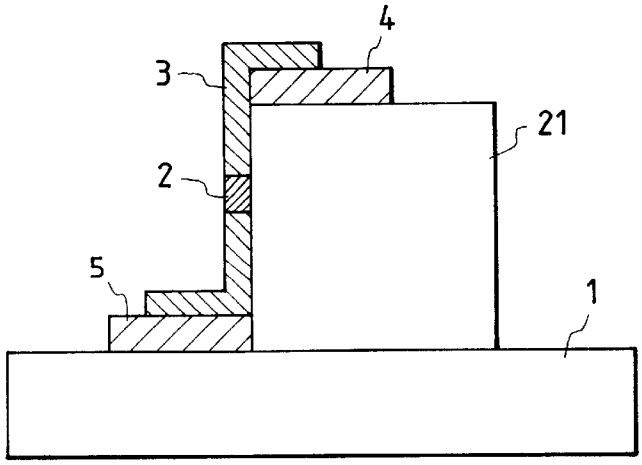
FIG. 2 is a schematic view of a step type surface conduction electron-emitting device that can be used for the purpose of the invention.

FIG. 2 is a schematic cross sectional view of a step type semiconductor electron-emitting device, illustrating its basic configuration. In FIG. 2, reference symbol 21 denotes a step-forming section. Otherwise, the components that are same as or similar to those of the device of FIGS. 1A and 1B are denoted by the same reference symbols.

The device comprises a substrate 1, an electron emitting region 2, an electroconductive thin film 3 and device electrodes 4 and 5, which are made of materials same as a flat type surface conduction electron-emitting device as described above.

The step-forming section 21 is made of an insulating material such as $SiO_2$ produced by vacuum evaporation, printing or sputtering. The height of the step-forming section 21 corresponds to the distance L separating the device electrodes of a flat type surface conduction electron-emitting device as described above (FIG. 1A), or between several hundred angstroms and tens of several micrometers. Preferably, the height of the step-forming section 11 is between hundreds of several angstroms and several micrometers, although it is selected as a function of the method of producing the step-forming section 21 used there and the voltage to be applied to the device electrodes 4 and 5.

After forming the device electrodes 4 and 5 and the step-forming section 11, the electroconductive thin film 3 is laid on the device electrodes 4 and 5, although, conversely, the device electrodes 4 and 5 may be laid on the electroconductive thin film 3 which is formed first. As described above by referring to a plane type surface conduction electron-emitting device, the preparation of the electron-emitting region 2 is dependent the film thickness, the quality, the material of the electroconductive thin film 3 and conditions under which the energization forming process is carried out. Therefore, the electron emitting region 2 is not particularly limited to the one shown in FIG. 2 in terms of position and shape.

While the present invention is described hereinafter in terms of plane type surface conduction electron-emitting devices, they may be read as step type surface conduction electron-emitting devices.

Figure 3A:
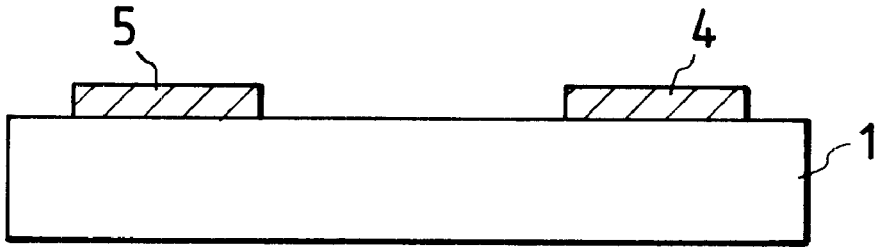
FIGS. 3A through 3C are schematic cross sectional side views of a surface conduction electron-emitting device that can be used for the purpose of the invention, showing different manufacturing steps.
Figure 3B:
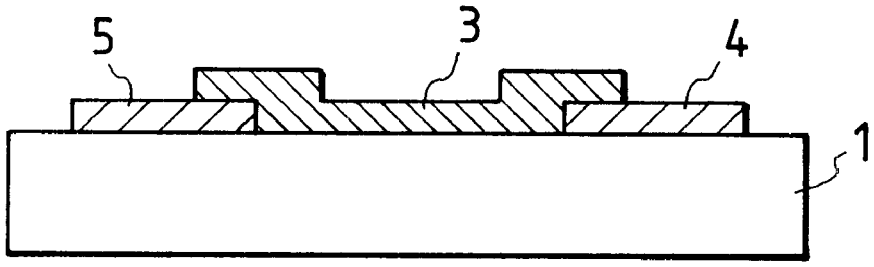
Figure 3C:
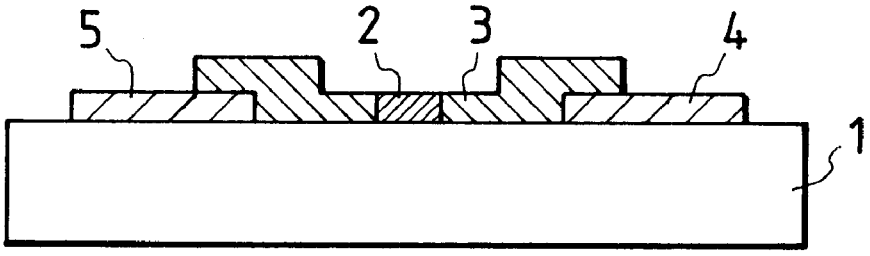

Now, a method of manufacturing a surface conduction electron-emitting device will be described by referring to FIGS. 3A through 3C, although there may be other methods that can feasibly be used for the purpose of the invention. Note that the components in FIGS. 3A through 3C that are same as those of FIGS. 1A and 1B are denoted respectively by the same reference symbols.

1) After thoroughly cleansing a substrate 1 with detergent, pure water and organic solvent, a material is deposited on the substrate 1 by means of vacuum evaporation, sputtering or some other appropriate technique for a pair of device electrodes 4 and 5, which are then produced by photolithography (FIG. 3A).
2) An organic metal thin film is formed on the substrate 1 carrying thereon the pair of device electrodes 4 and 5 to make it bridge the device electrodes 4 and 5 by applying an organic metal solution and leaving the applied solution for a given period of time. The organic metal solution may contain as a principal ingredient any of the metals listed above for the electroconductive thin film 3. Thereafter, the organic metal thin film is heated, baked and subsequently subjected to a patterning operation, using an appropriate technique such as lift-off or etching, to produce an electroconductive thin film 3 (FIG. 3B).

The material of the electroconductive thin film 3 is preferably a 2-phase mixture of an oxide and a metal or an oxide having a non-stoichiometric composition so that the resistance of the electroconductive thin film 3 may be regulated over a wide range by reoxidation or reduction.

While an organic metal solution is applied to the substrate to produce thin films in the above description, an organic metal film may alternatively be formed by vacuum evaporation, sputtering, chemical vapor deposition, dispersion coating, dipping, spinner coating or some other appropriate technique.

3) Thereafter, the device is subjected to a process referred to as "energization forming". "Energization forming" is a process conducted by conducting an electric current between the device electrodes 4 and 5 from a power source (not shown) in order to locally change the structure of the electroconductive thin film 3 and produce an electron emitting region 2 there (FIG. 3C). As a result of this current conduction treatment, the electroconductive thin film 3 is locally destructed, deformed or transformed to form an electron emitting region 3 having a structure different from that of the electroconductive thin film 3.

Figure 4A:
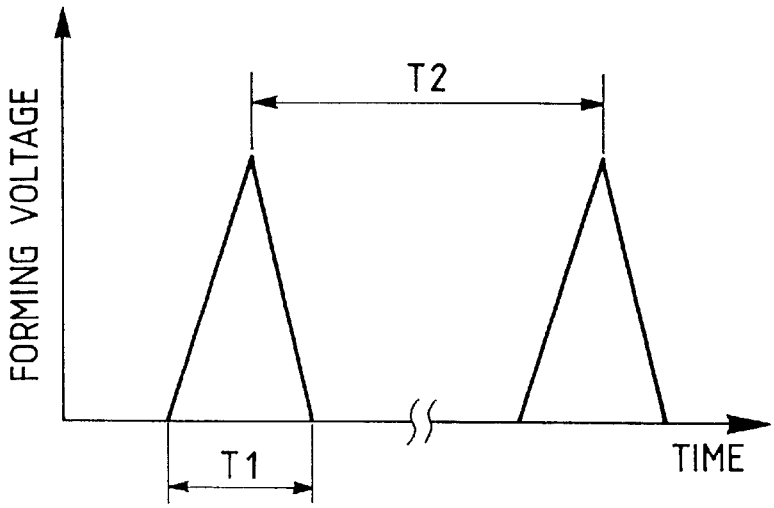
FIGS. 4A and 4B are graphs showing voltages waveforms that can be used for energization forming.
Figure 4B:
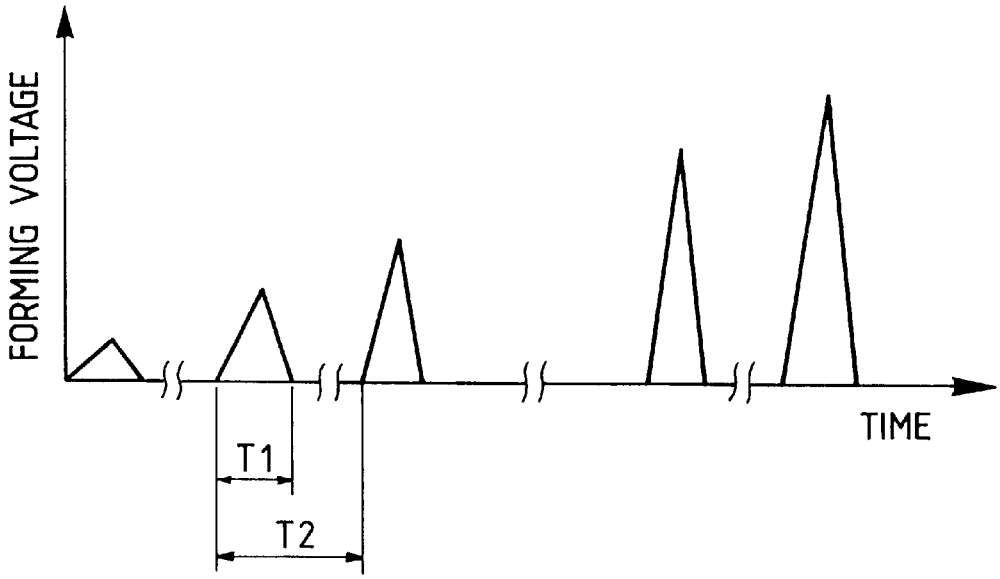

Examples of voltage waveform to be used for energization forming are shown in FIGS. 4A and 4B.

The voltage to be used for energization forming preferably has a pulse waveform. For energization forming, either a voltage pulse having a constant height is continuously applied (FIG. 4A) or a voltage pulse having an increasing wave height is applied (FIG. 4B).

The use of a voltage pulse having a constant wave height will be described firstly by referring to FIG. 4A.

In FIG. 4A, the voltage pulse has a pulse width T1 and a pulse interval T2, which are typically between 1 $\mu$sec. and 10 msec. and between 10 $\mu$sec. and 100 msec. respectively. The height of the triangular wave (the peak voltage for the energization forming operation) may be appropriately selected depending on the profile of the surface conduction electron-emitting device. The voltage is applied in vacuum of an appropriate degree for several to tens of several minutes. Note that the voltage waveform is not limited to triangular but some other appropriate waveform such as a rectangular waveform may alternatively be used.

Now, the use of a voltage pulse having an increasing wave height will be described by referring to FIG. 4B.

In FIG. 4B, the pulse voltage has an width T1 and a pulse interval T2 that are substantially similar to those of FIG. 4A. The height of the triangular wave (the peak voltage for the energization forming operation) is, however, increased stepwise with a step of, for example 0.1V and the voltage is applied in vacuum of an appropriate degree as described above by referring to FIG. 4A.

The energization forming operation will be terminated by measuring the current running through the device electrodes when a voltage that is sufficiently low and cannot locally destroy or deform the electroconductive thin film 3, or about 0.1V, is applied to the device during an interval T2 of the pulse voltage. Typically the energization forming operation is terminated when a resistance greater than 1M ohms is observed for the device current running through the electroconductive thin film 3 while applying a voltage of approximately 0.1V to the device electrodes.

Figure 5:
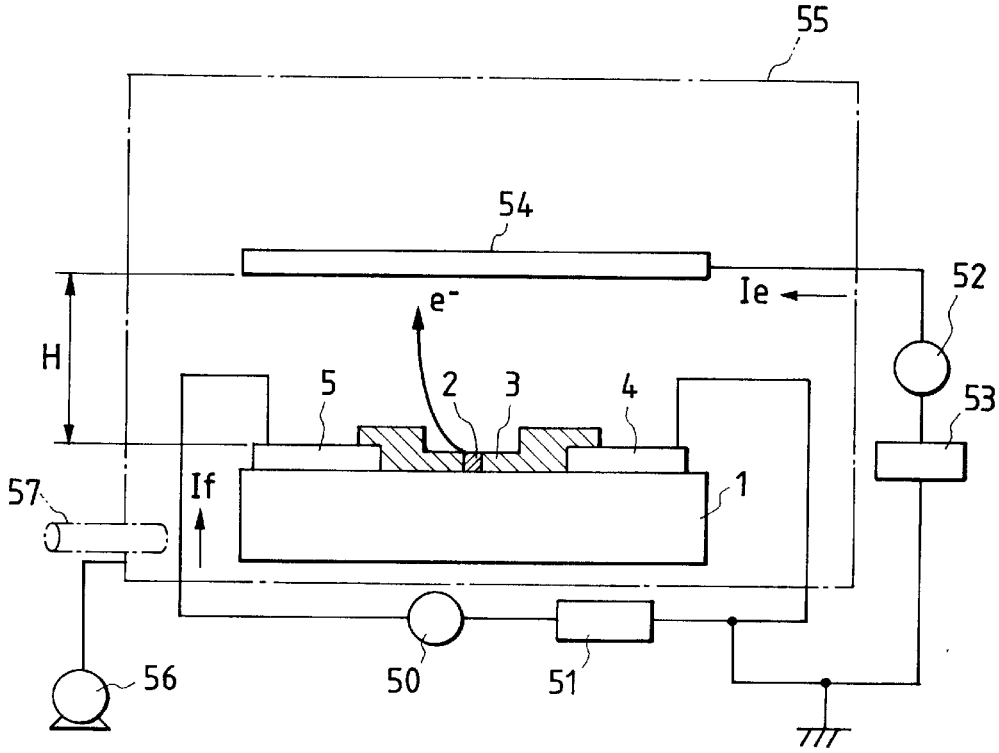
FIG. 5 is a schematic diagram of a gauging system to be used for a surface conduction electron-emitting device.

FIG. 5 is a schematic block diagram of a gauging/evaluation system where the above energization forming process and the subsequent processes are carried out for the surface conduction electron-emitting device. The gauging/evaluation system will now be described below.

In FIG. 5, the components that are same as those of FIGS. 1A and 1B are denoted respectively by the same reference symbols. Otherwise, the gauging/evaluation system has a power source 51 for applying a device voltage Vf to the device, an ammeter 50 for metering the device current If running through the thin film 3 between the device electrodes 4 and 5, an anode 54 for capturing the emission current Ie produced by electrons emitted from the electron-emitting region 2 of the device, a high voltage source 53 for applying a voltage to the anode 54 of the gauging/evaluation system and another ammeter 52 for metering the emission current Ie produced by electrons emitted from the electron-emitting region 2 of the device, a vacuum chamber 55, an exhaust pump 56 and a gas inlet port 57.

The surface conduction electron-emitting device and the anode 54 as well as other devices are arranged in the vacuum chamber 55. Instruments including a vacuum gauge and other pieces of equipment (not shown) necessary for the gauging/evaluation system are arranged in the vacuum chamber 55 so that the performance of the surface conduction electron-emitting device in the chamber may be properly tested.

The vacuum pump 56 is provided with an ordinary high vacuum system comprising a turbo pump or a rotary pump and an ultra-high vacuum system comprising an ion pump. The entire vacuum chamber 55 and the substrate 1 of the surface conduction electron-emitting device therein can be heated to about 200° C. by means of a heater. In the process of assembling a display panel comprising an electron source according to the invention, which will be described hereinafter, such a gauging/evaluation system can be used for the energization forming process and the subsequent processes when the display panel and the pieces located in the inside are so designed that they can be operated as a vacuum chamber 55 and corresponding pieces therein.

4) Subsequently, the device is preferably subjected to an activation process.

In an activation process, a voltage pulse having a constant wave height is repeatedly applied to the device in vacuum of $10^{-4}$ to $10^{-5}$ torr so that carbon or a carbon compound is deposited on the electron emitting region 2 from the organic substances remaining in the vacuum to remarkably improve the performance of the device in terms of the device current and the emission current. Desirably, the activation process is terminated when the emission current gets to a saturated state, while observing the device current If and the emission current Ie. The pulse width, the pulse interval and the pulse wave height of the voltage pulse to be used for the activation process will be appropriately selected. For the purpose of the invention, carbon and carbon compounds include graphite (both monocrystalline and polycrystalline) and noncrystalline carbon (which refers to amorphous carbon and a mixture of amorphous carbon and fine crystal grains of polycrystalline graphite) and the thickness of the deposited film is preferably less than 500 angstroms, more preferably less than 300 angstroms.

An electron source according to the invention may be realized by arranging surface conduction electron-emitting devices in a manner as described below.

A total of n Y-directional wires are arranged on a total of m X-directional wires with an interlayer insulation layer disposed therebetween and a surface conduction electron-emitting device is arranged at each crossing with the device electrodes connected to the related X- and Y-directional wires respectively. This arrangement is referred to as a simple matrix arrangement.

In view of the basic characteristic features of a surface conduction electron-emitting device, each of the surface conduction electron-emitting devices arranged to a simple matrix arrangement can be controlled for electron emission by controlling the wave height and the wave width of the pulse voltage applied to the opposite electrodes of the device when the voltage is above a threshold voltage level. On the other hand, the device does not practically emit any electron below the threshold voltage level. Therefore, regardless of the number of electron-emitting devices arranged in an apparatus, desired surface conduction electron-emitting devices can be selected and controlled for electron emission in response to an input signal by applying a pulse voltage to each of the selected devices. In other words, each of the surface conduction electron-emitting devices of a simple matrix arrangement can be selected and driven independently by selecting the related wires.

Thus, an electron source can be realized on the basis of simple matrix arrangement. This will be described further by referring to FIG. 6.

Figure 6:
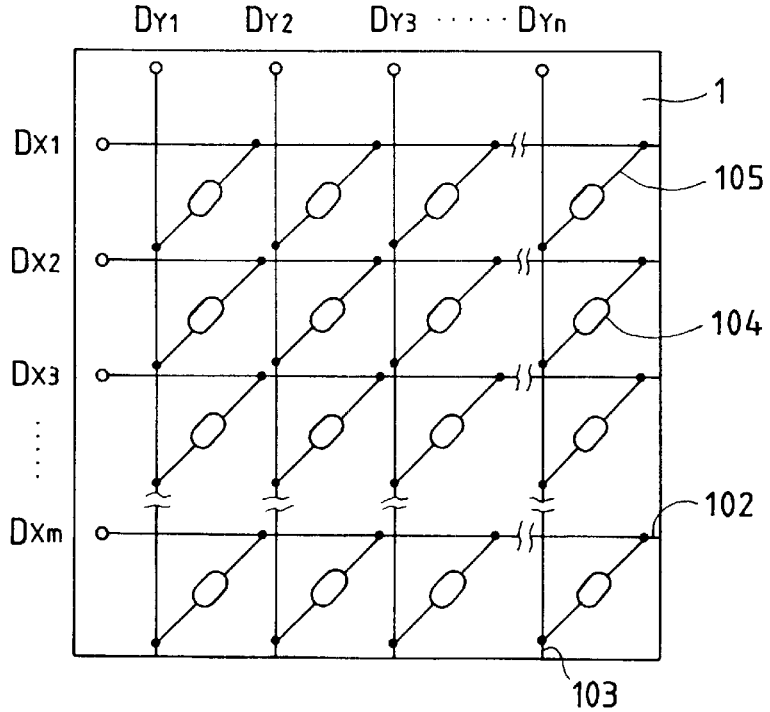
FIG. 6 is a schematic plan view of an electron source having a matrix wiring arrangement.

FIG. 6 is a schematic plan view of a glass substrate 1 of the type described earlier, that carries thereon a plurality of surface conduction electron-emitting devices 104, the number and the profile of which may be appropriately determined depending on the application of the electron source.

There are provided a total of m X-directional wires 102, which are donated by Dx1, Dx2, . . . , Dxm and made of an electroconductive metal produced by vacuum evaporation, printing or sputtering on the substrate 1. These wires are so designed in terms of material, thickness and width that a substantially equal voltage may be applied to the surface conduction electron-emitting devices 104. A total of n Y-directional wires 103 are arranged and donated by Dy1, Dy2, . . . , Dyn, which are similar to the X-directional wires 102 in terms of material, thickness and width.

An interlayer insulation layer (not shown) is disposed between the m X-directional wires 102 and the n Y-directional wires 103 to electrically isolate them from each other. (Both m and n are integers.)

The interlayer insulation layer (not shown) is typically made of $SiO_2$. Care should be taken in particular in the selection of the film thickness, the material and the manufacturing method of the interlayer insulation layer so that it may withstand any potential difference that may arise at the crossings of the X-directional wires 102 and the Y-directional wires 103.

The oppositely arranged paired electrodes (not shown) of each of the surface conduction electron-emitting devices 104 are connected to related one of the m X-directional wires 102 and related one of the n Y-directional wires 103 by respective connecting wires 105 which are made of an electroconductive metal and formed by vacuum evaporation, printing or sputtering.

The electroconductive metal material of the m X-directional wires 102, the n Y-directional wires 103 and the connecting wires 105 and that of the device electrodes may be same or contain a common element as an ingredient. Alternatively, they may be different from each other. These materials may be appropriately selected typically from the candidate materials listed above for the device electrodes. If the device electrodes and the connecting wires are made of a same material, they may be collectively called device electrodes without discriminating the connecting wires. The surface conduction electron-emitting devices 104 may be arranged either on the substrate 1 or on the interlayer insulation layer (not shown).

The X-directional wires 102 are electrically connected to a scan signal application means (not shown) for applying a scan signal to a selected row of surface conduction electron-emitting devices 104.

On the other hand, the Y-directional wires 103 are electrically connected to a modulation signal generation means (not shown) for applying a modulation signal to a selected column of surface conduction electron-emitting devices 104 and modulating the selected column according to an input signal. Note that the drive voltage to be applied to each surface conduction electron-emitting device is expressed as the voltage difference of the scan signal and the modulation signal applied to the device.

Figure 7:
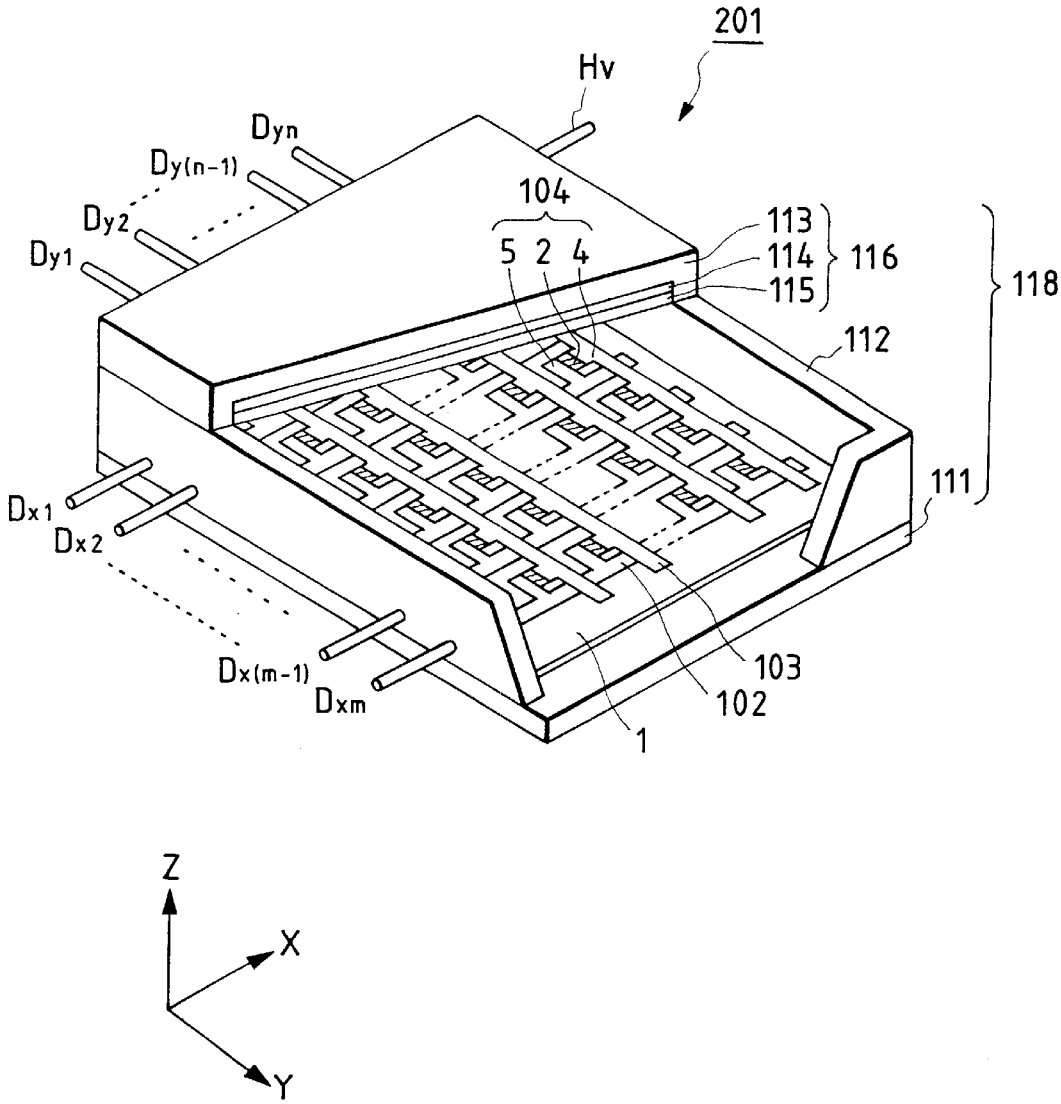
FIG. 7 is a schematic perspective view of an image-forming apparatus comprising an electron source having a matrix wiring arrangement.
Figure 8A:
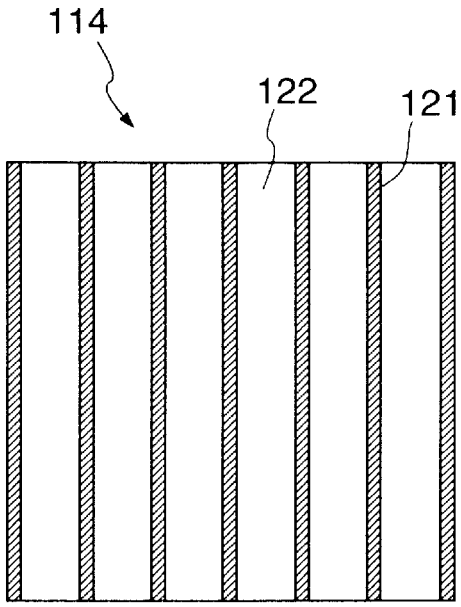
FIGS. 8A and 8B are two possible arrangements of fluorescent members that can be used for the purpose of the invention.
Figure 8B:
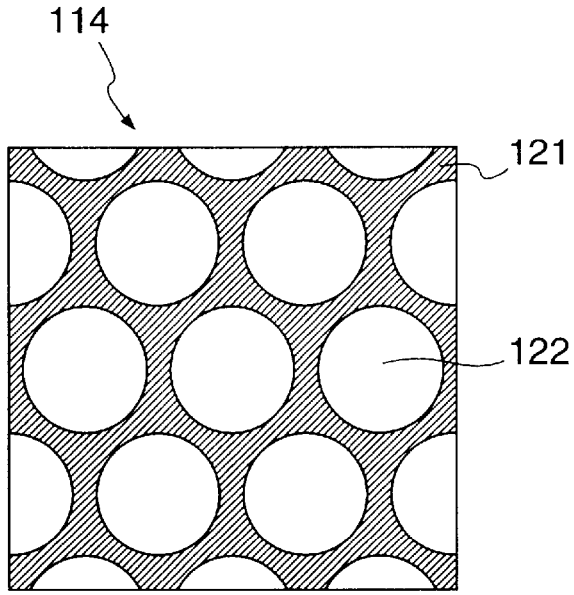

Now, an image-forming apparatus comprising an electron source having a simple matrix arrangement as described above will be described by referring to FIGS. 7, 8A and 8B. FIG. 7 is a partially cut away schematic perspective view of the image forming apparatus and FIGS. 8A and 8B are schematic views, illustrating two possible configurations of a fluorescent film 114 that can be used for the image forming apparatus.

Referring firstly to FIG. 7 illustrating the basic configuration of the display panel of the image-forming apparatus, it comprises an electron source substrate 1 of the above described type carrying thereon a plurality of electron-emitting devices, a rear plate 111 rigidly holding the electron source substrate 1, a face plate 116 prepared by laying a fluorescent film 114 and a metal back 115 on the inner surface of a glass substrate 113 and a support frame 112. The rear plate 111, the support frame 112 and the face plate 116 are bonded together to form a hermetically sealed envelope 118 by applying frit glass thereto and baking them at 400 to 500° C. for more than 10 minutes in the atmosphere or in nitrogen.

In FIG. 7, reference numeral 2 denotes the electron-emitting region of each electron-emitting device as shown in FIGS. 1A and 1B and reference numerals 102 and 103 respectively denotes the X-directional wire and the Y-directional wire connected to the respective device electrodes of each electron-emitting device. The X-directional wires and the Y-directional wires are provided respectively with external terminals Dx1 through Dxm and Dy1 through Dyn.

While the envelope 118 is formed of the face plate 116, the support frame 112 and the rear plate 111 in the above described embodiment, the rear plate 111 may be omitted if the substrate 1 is strong enough by itself because the rear plate 111 is provided mainly for reinforcing the substrate 1. If such is the case, an independent rear plate 111 may not be required and the substrate 1 may be directly bonded to the support frame 112 so that the envelope 118 is constituted of a face plate 116, a support frame 112 and a substrate 1. The overall strength of the envelope 118 may be increased by arranging a number of support members called spacers (not shown) between the face plate 116 and the rear plate 111.

FIGS. 8A and 8B schematically illustrate two possible arrangements of fluorescent film. While the fluorescent film 111 comprises only a single fluorescent body if the display panel is used for showing black and white pictures, it needs to comprise for displaying color pictures black conductive members 121 and fluorescent bodies 122, of which the former are referred to as black stripes (FIG. 8A) or members of a black matrix (FIG. 8B) depending on the arrangement of the fluorescent bodies. Black stripes or members of a black matrix are arranged for a color display panel so that the fluorescent bodies 122 of three different primary colors are made less discriminable and the adverse effect of reducing the contrast of displayed images of external light is weakened by blackening the surrounding areas. While graphite is normally used as a principal ingredient of the black conductive members 121, other conductive material having low light transmissivity and reflectivity may alternatively be used.

A precipitation or printing technique is suitably be used for applying fluorescent bodies 122 on the glass substrate 111 regardless of black and white or color display.

A metal back 115 is typically arranged on the inner surface of the fluorescent film 114. The metal back 115 is provided in order to enhance the luminance of the display panel by causing the rays of light emitted from the fluorescent bodies 122 and directed to the inside of the envelope to be mirror reflected toward the face plate 116 and enhance the brightness, to use it as an electrode for applying an accelerating voltage to electron beams and to protect the fluorescent bodies 122 against damages that may be caused when negative ions generated inside the envelope 118 collide with them. It is prepared by smoothing the inner surface of the fluorescent film 114 (in an operation normally called "filming") and forming an A1 film thereon by vacuum deposition after forming the fluorescent film 114.

A transparent electrode (not shown) may be formed on the face plate 116 in order to raise the conductivity of the fluorescent film 114.

Care should be taken to accurately align each set of color fluorescent bodies 122 and a corresponding electron-emitting device 104, if a color display is involved, before the above listed components of the envelope are bonded together.

Then, the inside of the envelope 118 is evacuated by way of an exhaust pipe (not shown) to achieve a degree of vacuum of about $10^{-7}$ torr in the inside and then hermetically sealed. A getter process may be conducted in order to maintain the achieved degree of vacuum in the inside of the envelope 118 after it is sealed. In a getter process, a getter (not shown) arranged at a predetermined position in the envelope 118 is heated to form a film by evaporation. A getter typically contains Ba as a principal ingredient and can maintain a degree of vacuum typically between $1\times10^{-5}$ and $1\times10^{-7}$ torr within the envelope 118 by the adsorption effect of the film deposited by evaporation.

The energization forming and the subsequent process for manufacturing surface conduction electron-emitting devices are typically conducted immediately before or after the envelop 118 is sealed in a manner as described above.

Thus, a display apparatus according to the invention and comprising an electron source with a simple matrix arrangement as described above can find a wide variety of industrial and commercial applications because it can operate as a display apparatus for television broadcasting, as a terminal apparatus for video teleconferencing, as an editing apparatus for still and movie pictures, as a terminal apparatus for a computer system, as an optical printer comprising a photosensitive drum and in many other ways.

Now, the present invention will be described by way of preferred embodiments of the invention.

Embodiment 1

Figure 9:
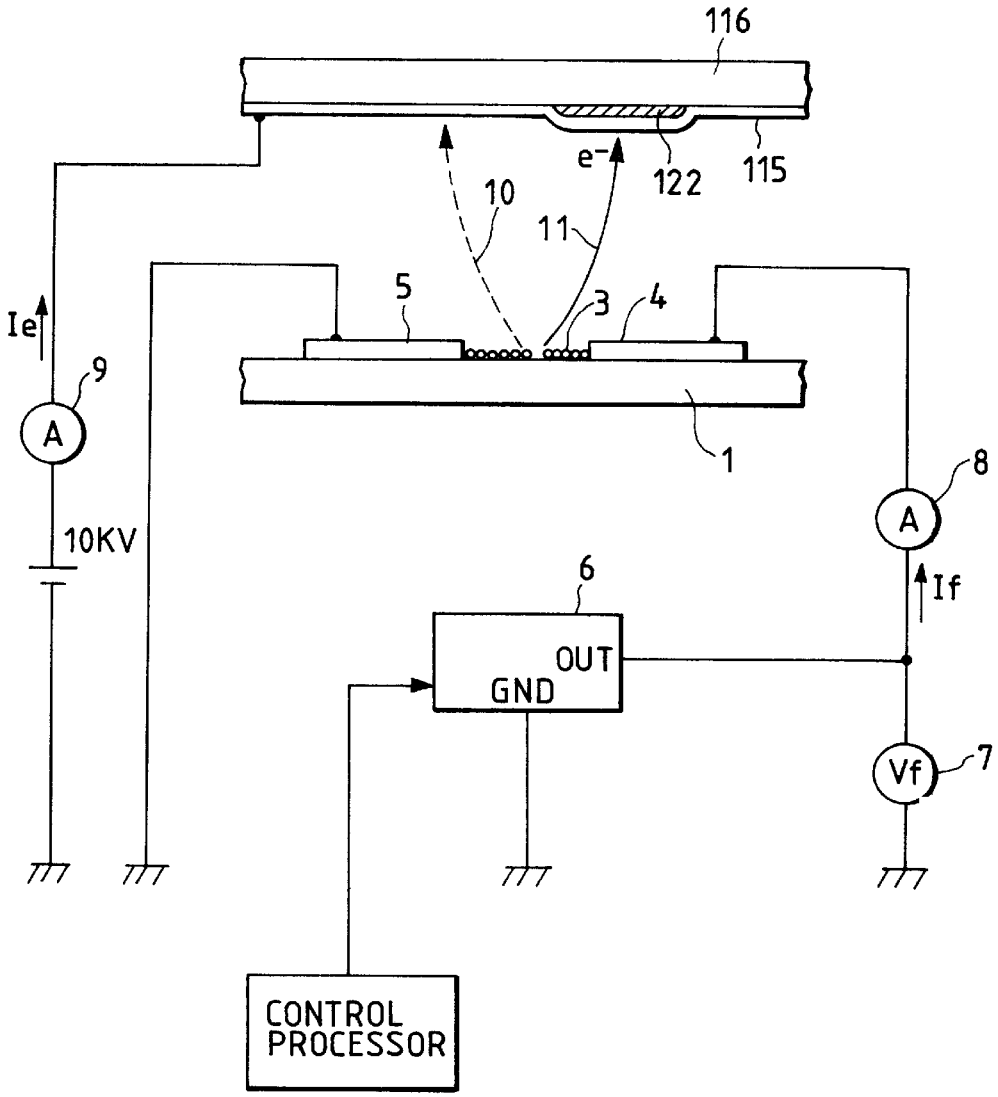
FIG. 9 is a block diagram of part of a first embodiment of the invention, which is an electron source, and a drive circuit to be used for it, the electron source being shown in cross section.

FIG. 9 is a block diagram of part of an image-forming apparatus comprising an embodiment of electron source according to the invention and a drive circuit for driving the electron source. While FIG. 9 is a simplified illustration, the electron source and the image-forming apparatus have respective configurations as described above by referring to FIGS. 6, 7, 8A and 8B. Referring to FIG. 9, there are shown a substrate 1 made of soda lime glass, device electrodes 4 and 5 typically made of Ni and disposed vis-a-vis and separated from each other by 2 micrometers. Reference numeral 3 denotes a film of ultrafine particles of a substance such as Pd that can emit electrons. The film includes an electron emitting region as part thereof. The device electrodes 4 and 5 and the film of ultrafine particles 3 arranged on the substrate 1 constitute a surface conduction electron-emitting device. While the device electrodes 4 and 5 are symmetrically formed in this embodiment, they are referred respectively to first and second electrodes for convenience sake.

Reference numeral 116 denotes a face plate of a glass panel carrying on the inner surface thereof a fluorescent body 122 and a metal back 115. The image-forming apparatus can emit visible light with sufficiently brightness if the fluorescent body 112 is irradiated with electron beams to an intensity of about 1 $\mu$A while an accelerating voltage of, for example, 10 kV is being applied to the metal back 115.

Reference numeral 6 denotes a voltage source for applying an appropriate voltage between the first and second electrodes of the surface conduction electron-emitting device. The operation of the voltage source will be described later by referring to FIGS. 11A to 11D.

Otherwise, there are shown a voltmeter 7 and ammeters 8 and 9, which are shown in FIG. 9 but not indispensable components of the embodiment.

Figure 10:
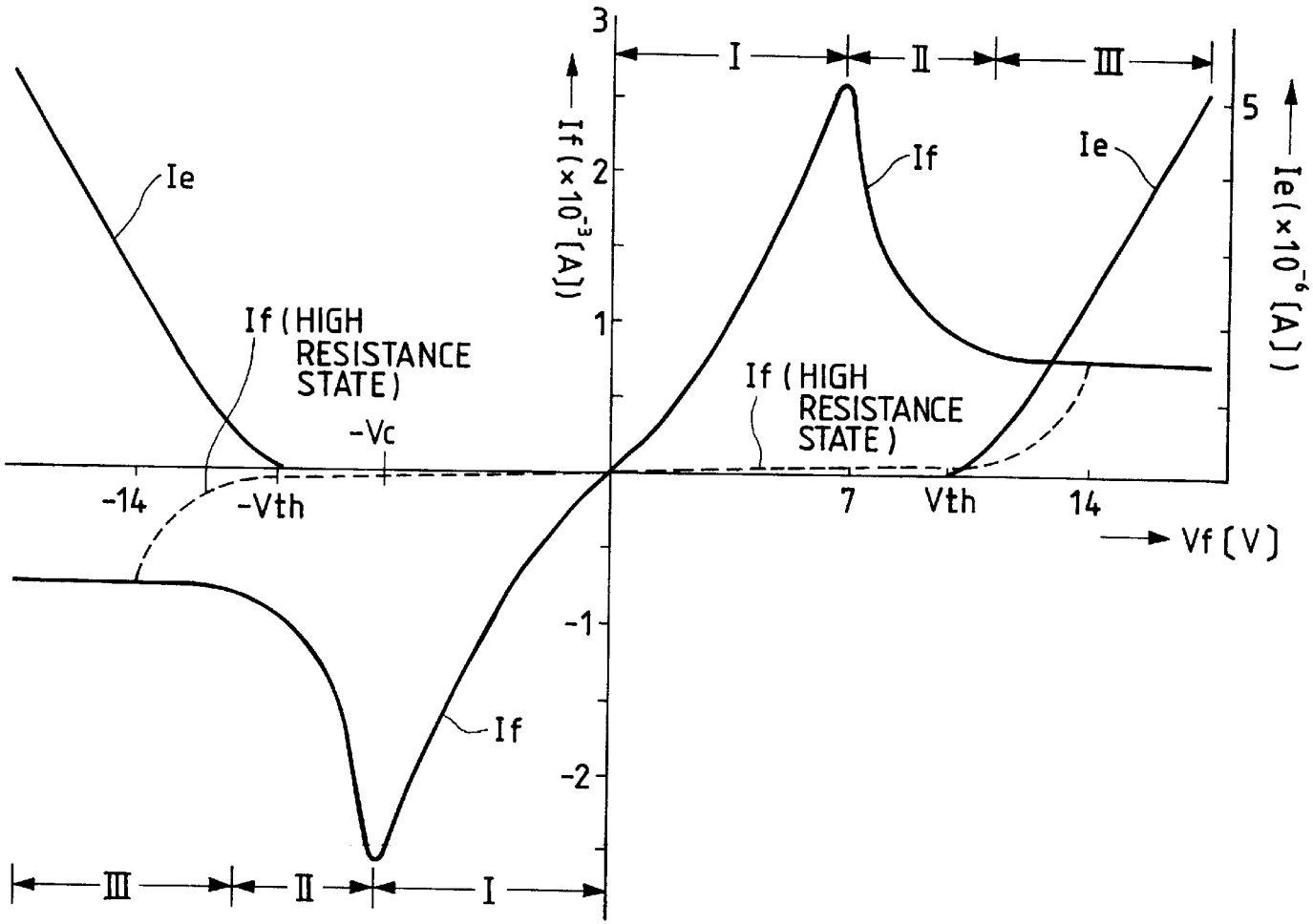
FIG. 10 is a graph showing the performance of a surface conduction electron-emitting device of the first embodiment.

Before describing the operation of the embodiment of electron source, some of the characteristic features of each of the surface conduction electron-emitting devices of this embodiment will be described by referring to FIG. 10. In FIG. 10, the transverse axis represents the voltage applied to between the first and second electrodes, which corresponds to the reading of the voltmeter 7 in FIG. 9.

Of the two ordinate axes in FIG. 10, the one at the center represents the intensity of the electric current flowing through the surface conduction electron-emitting device, which corresponds to the reading of the ammeter 8 in FIG. 9. (The direction indicated by arrow If in FIG. 9 is defined here as the positive direction.)

The right ordinate axes in FIG. 10 represents the intensity of the electric current produced by the output electron beam of the surface conduction electron-emitting device, which corresponds to the reading of the ammeter 9 in FIG. 9.

As described earlier, the If indicated by a solid line in FIG. 10 can be divided into three regions as a function of the applied voltage Vf. Namely, the I region where the device current If increases as the applied voltage rises (monotonically increasing region), the II region where the device current If decreases as the applied voltage rises (VCNR region) and the III region where the emission current Ie appears and the device current does not decrease if the applied voltage is raised further.

FIG. 10 also shows the performance of the surface conduction electron-emitting device when a voltage Vf with a reversed polarity is applied and, as shown, the device current If flows in the opposite direction for a similar performance. The threshold voltage where the If moves from the I region into the II region when the applied voltage Vf has a reversed polarity is referred to as −Vc here. In other words, the If becomes a local maximum at −Vc. As seen from the line of the emission current Ie produced by the electron beam of the device, the surface conduction electron-emitting device emits an electron beam with an intensity that varies in a same manner regardless of the polarity of the applied voltage Vf.

Additionally, when a high resistance realizing pulse is applied, the surface conduction electron-emitting device moves to a high resistance state showing a resistance higher relative to the If characteristic as indicated by the solid line and remains in that state for a given period of time.

Now, a high resistance realizing pulse for causing the surface conduction electron-emitting device to move into a high resistance state will be described. It is a voltage pulse having an amplitude at least greater than Vc, a polarity reverse to that of the drive voltage (or a negative voltage pulse lower than −Vc) and a rising rate (the rate of change with time heading for 0V) at least greater than 10V/sec.

Thus, the surface conduction electron-emitting device behaves in a manner as described above. Now, the embodiment of electron source and the image-forming apparatus comprising the embodiment will be described by referring to FIG. 9.

Briefly, the voltage source 6 applies a high resistance realizing pulse and transfers the surface conduction to a high resistance state in the first place and, thereafter, it causes the device to emit an electron beam toward the fluorescent body to form an intended image according to an image signal.

For the operation of applying a high resistance realizing pulse, the second electrode 5 of the surface conduction electron-emitting device operates as the positive electrode while the first electrode 4 takes the role of the negative electrode. When, for example, a pulse of −14V is applied, the device emits an electron beam of about $1\times10^{-6}$ A. The electron beam then made to fly along a trajectory indicated by a broken line 10, which is substantially a parabola, as an electric field produced by the metal back 115 is applied thereto. However, since a black conductive member 121, which may be referred to as black stripe or black matrix, is arranged at the position to be hit by the electron beam and no fluorescent body 122 is found on the broken line 10 of trajectory, the electron beam would not cause any emission of light. Thus, any undesired emission of light due to a high resistance realizing pulse that can adversely affect the image forming operation of the image-forming apparatus is effectively prevented from occurring.

On the other hand, for the operation of causing the fluorescent body 122 to emit light according to an image signal, the first and second electrodes 4 and 5 operate as the positive and negative electrodes respectively. For this operation, the electric field generated by the device electrodes 4 and 5 and the metal back 115 applies a force to the emitted electron beam along a direction that is opposite to that of the force applied to the high resistance realizing pulse so that the electron beam follows a trajectory of parabola indicated by a solid line 11. Thus, the electron beam penetrates the metal back 115 and excite the fluorescent body 122, which by turn emit visible light with a sufficient intensity.

The operation of the embodiment for applying a high resistance realizing pulse and displaying an image may be understood from the above description. Now, the relationship between the applied voltage Vf, the device current If and the emitted electron beam Ie will be supplementally described below by referring to FIGS. 11A through 11D.

Figure 11A:
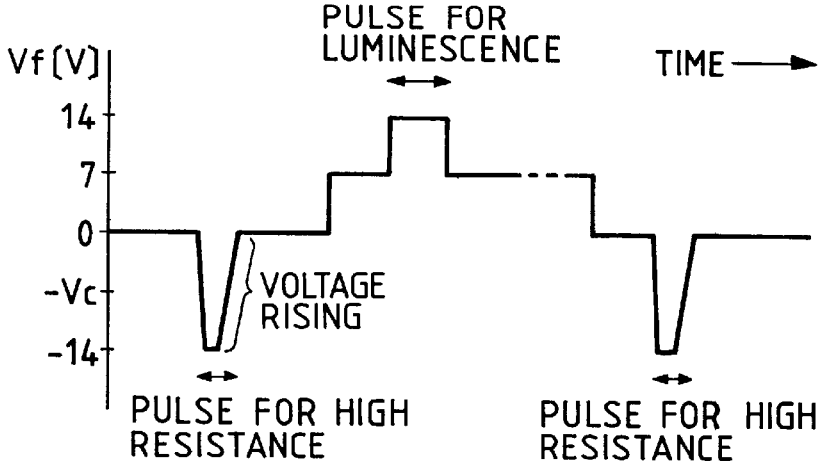
FIGS. 11A through 11D are graphs how Vf, If and Ie change with time.

FIG. 11A is a graph showing how the voltage Vf applied to the surface conduction electron-emitting device by the voltage source 6 changes with time. Firstly, a high resistance realizing pulse having an amplitude exceeding Vc and a rising rate of greater than 10V/sec. is applied. Then, a drive voltage is applied to cause the fluorescent body 122 to emit light according to an image signal. Note that, however, in the case of an electron source comprising a number of surface conduction electron-emitting devices arranged in the form of a simple matrix, which are scanned sequentially, 7V or 0V is applied to the surface conduction electron-emitting device while the devices of the other rows are being scanned as described above. As the row of the surface conduction electron-emitting device is scanned and it is to be driven to cause the corresponding fluorescent body 122 to emit light, a voltage (14V in this embodiment) exceeding Vth is applied thereto so that the device emits an electron beam.

Figure 11B:
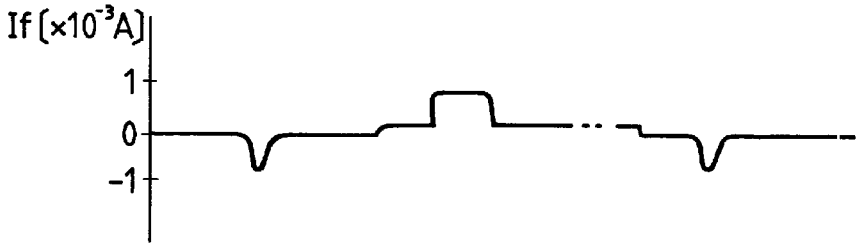

FIG. 11B shows the electric current If flowing through the surface conduction electron-emitting device under this condition. While a high resistance realizing pulse is being applied, an electric current of about $1\times10^{-3}$ A flows in the reverse direction and then the surface conduction electron-emitting device moves into a high resistance state so that the electric current flowing therethrough becomes as low as $0.1\times10^{-3}$ A if 7V is applied thereto. Once 14V is applied as Vf, an electric current of about $1\times10^{-3}$ A flows but then it falls as low as $0.1\times10^{-3}$ A when the voltage drops to 7V because the surface conduction electron-emitting device is held to a high resistance state.

Figure 11C:
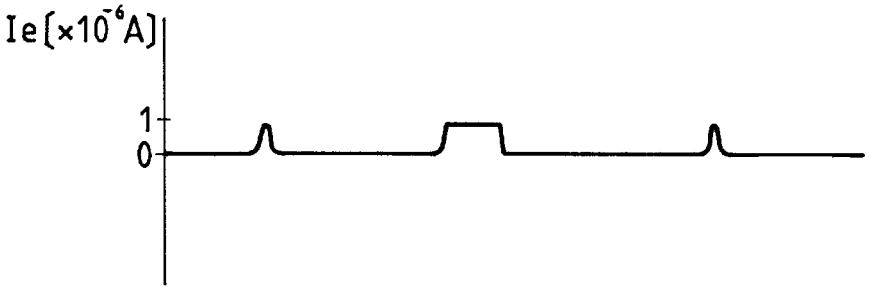

FIG. 11C shows the electron beam Ie emitted from the surface conduction electron-emitting device. As shown there, it emits an electron beams with an intensity of about $1\times10^{-6}$ A when a high resistance realizing pulse or a pulse for light emission is applied thereto. However, as described above, the electron beam emitted when a high resistance realizing pulse is applied to the device follows a trajectory that does not hit the fluorescent body 122 and, therefore, it does not adversely affect the image-forming operation.

Embodiment 2

Figure 12:
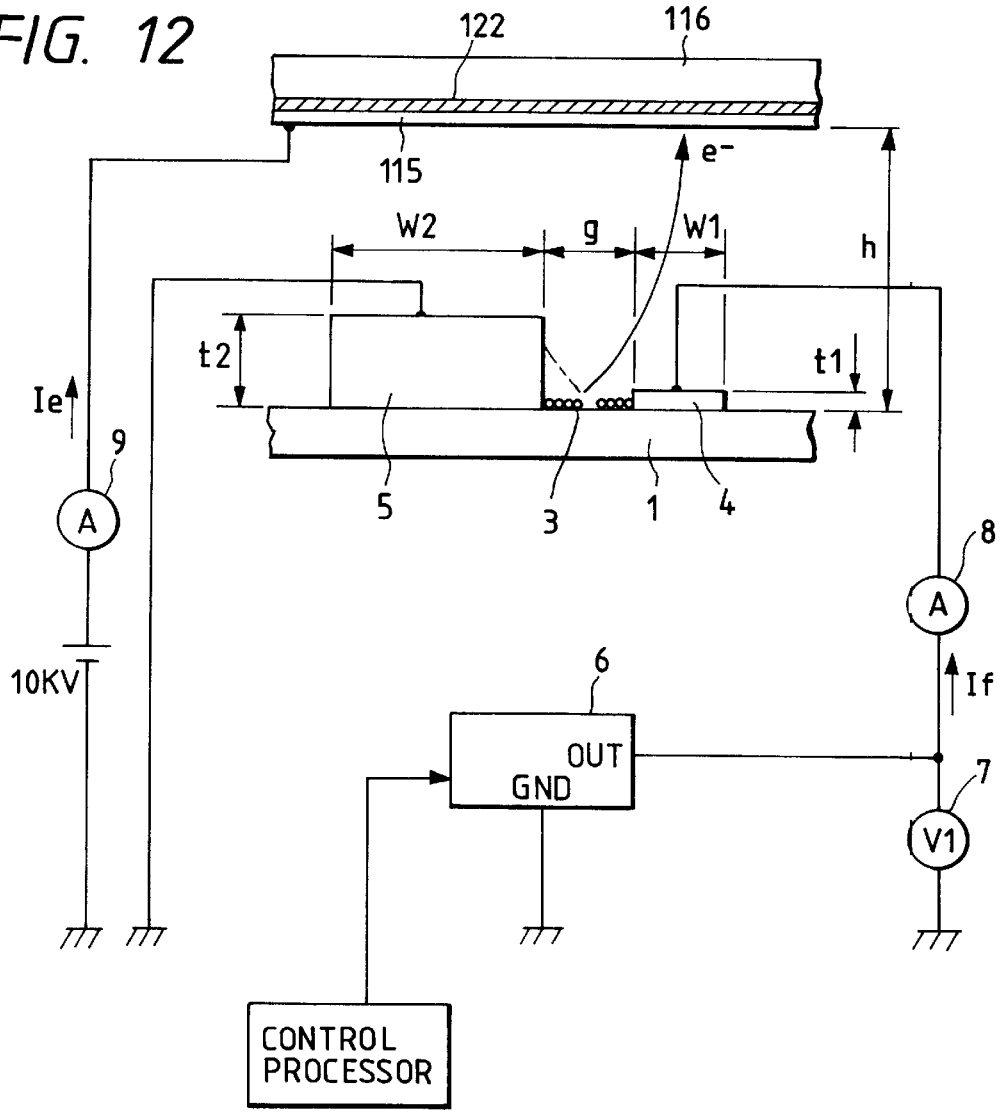
FIG. 12 is a block diagram of part of a second embodiment of the invention, which is an electron source, and a drive circuit to be used for it, the electron source being shown in cross section.

FIG. 12 is a block diagram of part of an image-forming apparatus comprising second embodiment of electron source according to the invention and a drive circuit for driving the electron source. While FIG. 12 is a simplified illustration, the electron source and the image-forming apparatus have respective configurations as described above by referring to FIGS. 6, 7, 8A and 8B. The components that are same or similar to those of the first embodiment are denoted respectively by the same reference symbols.

This embodiment differs from the first embodiment in the following aspects. While the first and second electrodes 4 and 5 of each surface conduction electron-emitting device had a same profile, they have different top levels and designed such that the electron beam emitted as a high resistance realizing pulse is applied thereto is absorbed by the second electrode 5 and does not go upward any further.

While the surface conduction electron-emitting device is enlarged unproportionally for easy understanding in FIG. 12, the first electrode 4 has a width of W1=10 $\mu$m and a height of t1=1,000 angstroms, while the second electrode 5 has a width of W2=100 $\mu$m and a height of t2=1 $\mu$m. The electrodes 4 and 5 are separated from each other by a distance of g=2 $\mu$m and the substrate 1 and the metal back 115 are separated from each other by a distance of h=10 mm or so.

Figure 13:
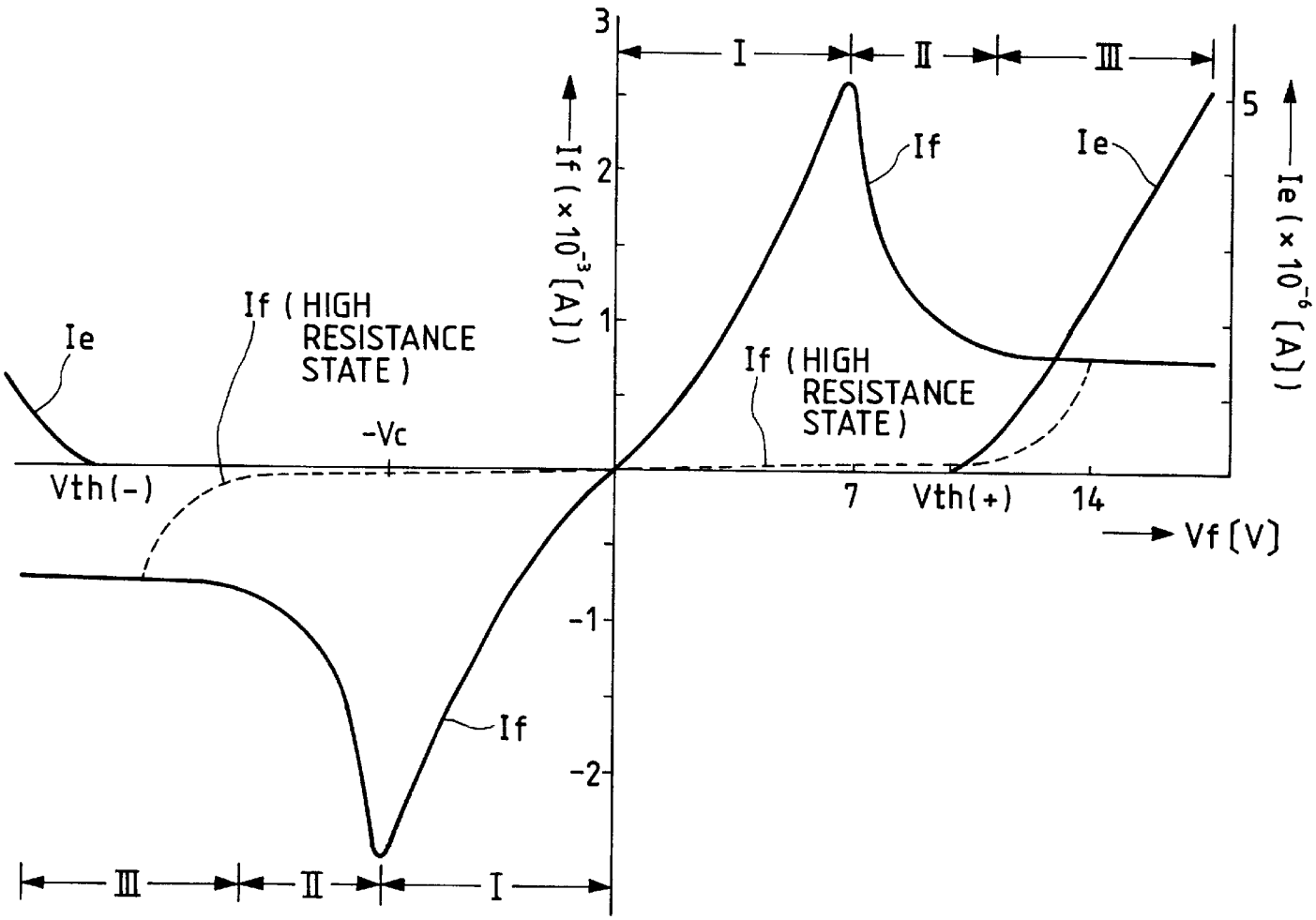
FIG. 13 is a graph showing the performance of a surface conduction electron-emitting device of the second embodiment.

The performance of the surface conduction electron-emitting device will now be described by referring to FIG. 13. As in the case of FIG. 10, the transverse axis of FIG. 13 represents Vf and If, If (in a high resistance state) and Ie are plotted there. While If and If (in a high resistance state) of the surface conduction electron-emitting device of this embodiment behave substantially same as their counterparts of the first embodiment, Ie of this embodiment performs differently from that of the first embodiment. More specifically, when Vf is a negative voltage, the electron beam emitted from the film 3 of ultrafine particles is absorbed by the second electrode 5 and can hardly gets to the fluorescent body 122 provided with a metal back. Thus, while the threshold voltage Vth (+) of Ie is about 10V when Vf is positive, the effective threshold voltage Vth (−) of Ie is as large as −16 when Vf is negative.

Differently stated, the surface conduction electron-emitting device of this embodiment does not emit any electron beam if a negative voltage pulse with an amplitude of 14V is applied as a high resistance realizing pulse so that there cannot take place any emission of light that can adversely affect the operation of image display.

In other words, the fluorescent body 122 of this embodiment does not have to be strictly aligned with the surface conduction electron-emitting device and may be extended over the entire screen as shown in FIG. 12.

Figure 11D:
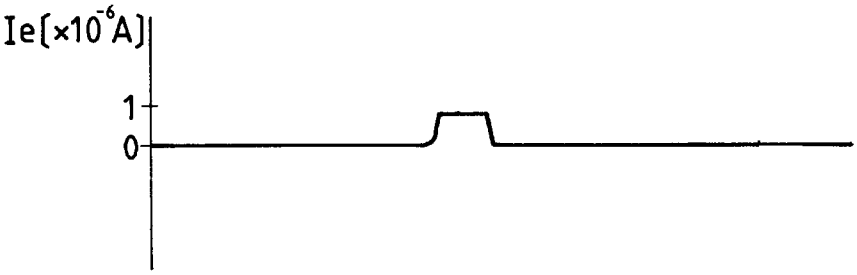

While Vf and If of this embodiment behave substantially same as their counterparts of the first embodiment shown in FIGS. 11A and 11B when the electron source is driven to operate, Ie behaves in a manner as illustrated in FIG. 11D because of the above described arrangement.

Note that the dimensions of the first and second electrodes 4 and 5 do not necessarily limited thereto. Generally speaking, the second electrode 5 effectively suppresses the emission of electron beam when Vf is negative if its height t2 is made greater than the height t1 of the first electrode 4.

In order to suppress the emission of electron beam due to a high resistance realizing pulse, t2 is preferably more than five times greater than t1 when the fluorescent body 122 (target) provided with a metal back 115 is separated from the surface conduction electron-emitting device by about h=10 mm and the accelerating voltage is about 10kV.

If a higher accelerating voltage is used or the distance h between the target and the device is reduced, t2 is preferable made by far greater than t1.

Embodiment 3

Figure 14:
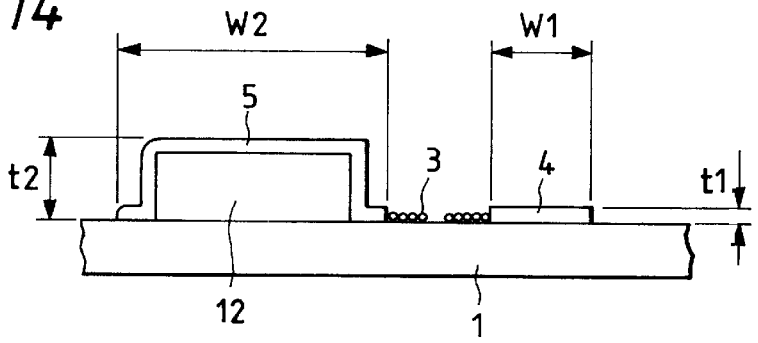
FIG. 14 is a schematic view of a surface conduction electron-emitting device of a third embodiment of electron source according to the invention.

The effective heights of the electrodes may be modified by using a technique as illustrated in FIG. 14.

Referring to FIG. 14, while the first and second electrodes 4 and 5 are made of a metal and have a same thickness of t1, the effective height t2 of the second electrode 5 can be increased by arranging an insulation layer under the second electrode 5.

Embodiment 4

Figure 15:
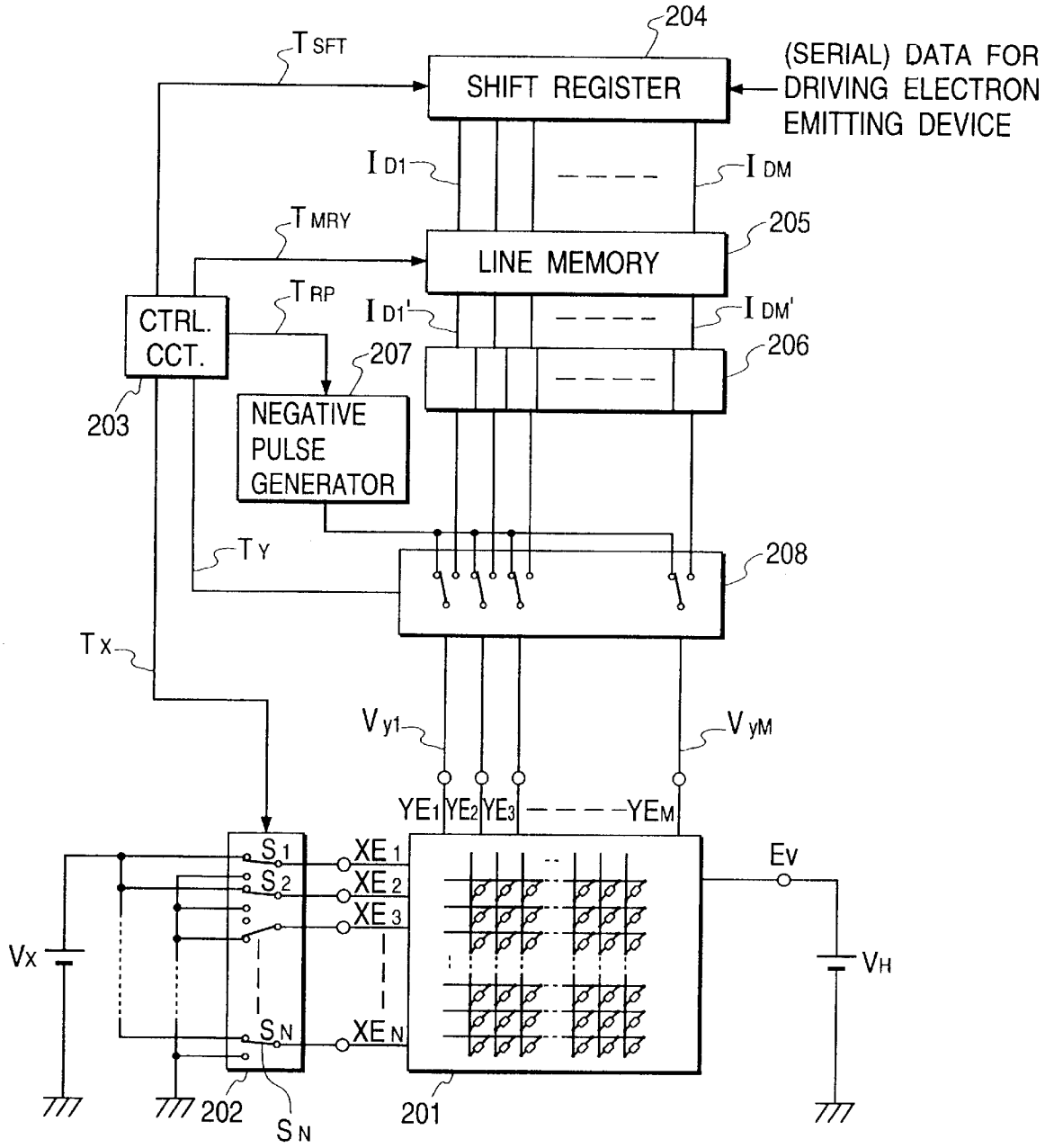
FIG. 15 is a circuit diagram of a fourth embodiment of the invention, which is an image-forming apparatus.

This is a panel type image-forming apparatus. FIG. 15 is a circuit diagram of the embodiment. Referring to FIG. 15, it comprises display panel 201, a switching device array 202, a control circuit 203, a shift register 204, a line memory 205, a drive device array 206, a negative pulse generator 207 and another switching device array 208.

Figure 16:
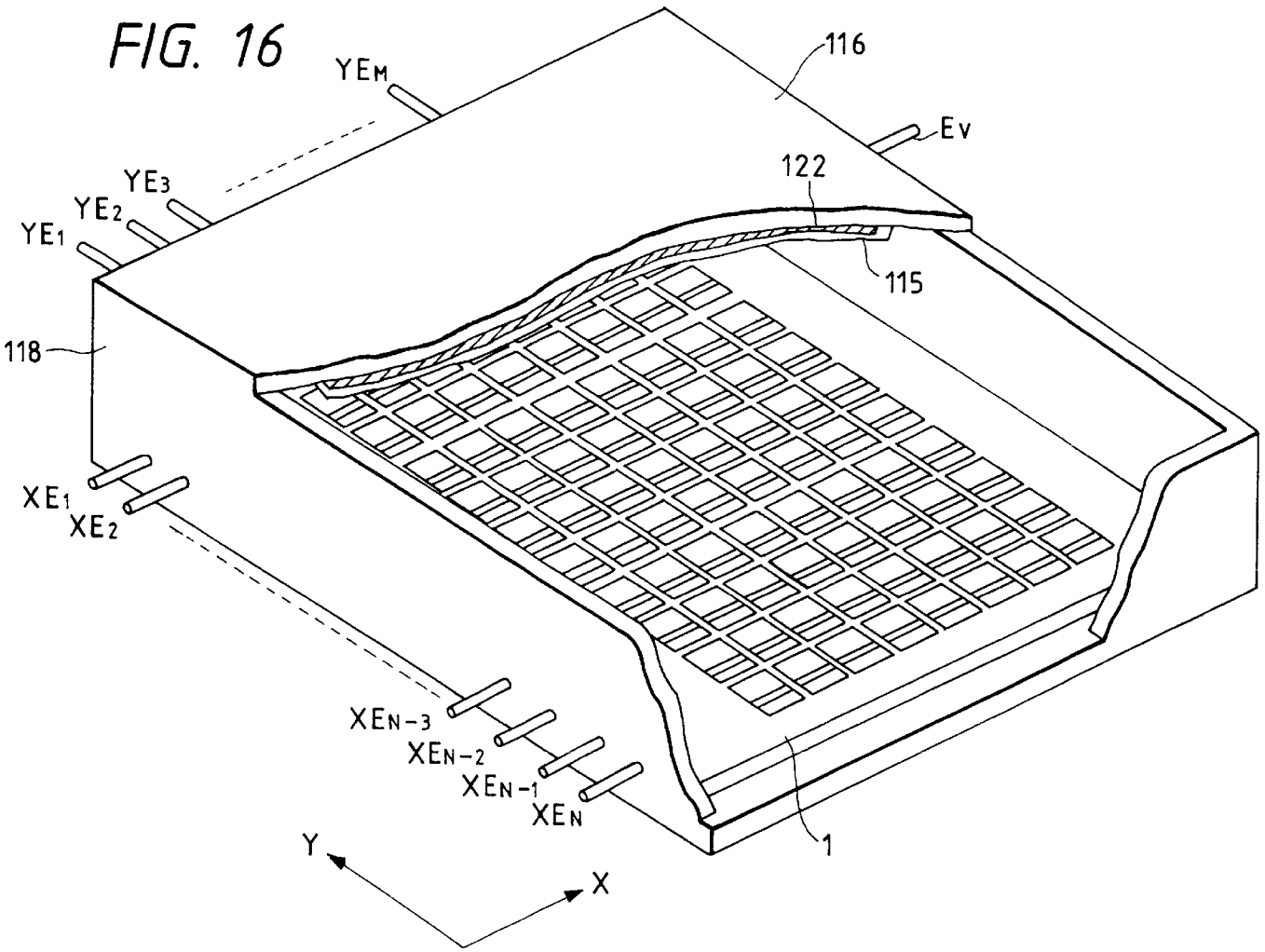
FIG. 16 is a schematic perspective view of the image-forming apparatus of the fourth embodiment.

The display panel is a flat panel type CRT as shown in a partly cut away view of FIG. 16. Referring to FIG. 16, an envelope 118 is provided as a glass vacuum container comprising a face plate 111 as part thereof. The face plate 111 is provided on the inner surface thereof with a transparent electrode typically made of ITO, which is by turn provided on the inside with a metal back 115 known in the field of CRT and prepared by mosaically arranging fluorescent bodies 122 of red, green and blue. The transparent electrode (not shown) is electrically connected to the outside of the envelope 118 by way of a terminal Ev for the application of an accelerating voltage.

In FIG. 16, reference numeral denotes a glass substrate secured to the bottom of the envelope 118. It carries on the upper surface conduction electron-emitting devices arranged in M rows and N columns in the form of simple matrix, which are electrically connected to the outside of the envelope 118 by way of terminals XE1 through XEN and YE1 through YEM respectively.

Back to FIG. 15, the terminal Ev of the display panel 201 is connected to a high voltage power source VH for applying an accelerating voltage, which may typically be as high as 10kV.

The terminals XE1 through XEN are connected respectively to the switching devices S1 through SN of the switching arrays 202 so that either 0V (ground level) or the power source voltage Vx, which may typically be about 7V, is applied to the devices of each row by way of the related switching device. While switching devices S1 through SN of the switching array 202 are shown schematically in FIG. 15, they may be FET pairs connected in the form of a totem pole or some other devices that are good for applying either 0V or 7V according to a control signal Tx.

The shift register 204 carries out for each line a serial/parallel conversion on serial image data that are externally transmitted in accordance with control signal Tsft fed from the timing control circuit 203. Since the display panel of this embodiment has a total of M pixels per line, the serial/parallel-converted image data for a line are sent out from the shift register 204 as M signals ID1 through IDM.

The line memory 205 fetches a set of image data for a line from the shift register 204 according to control signal Tmry fed from the timing control circuit 203. In FIG. 15, ID1' through IDN' denote output signals of the line memory 205.

The drive device array 206 produces either 14V or 7V (modulation voltages responsible for emission of light and non-emission of light respectively) according to the output signals ID1' through IDN' of the line memory 205.

On the other hand, the negative voltage pulse generator 207 generates a negative voltage pulse for bringing a selected surface conduction electron-emitting device 104 into a high resistance state according to control signal Trp fed from the control circuit 203. It may be needless to say that the negative voltage pulse has a predetermined amplitude and also a predetermined rising rate.

The switching device array 208 selects either the output of the drive device array 206 or that of the negative voltage pulse generator 207 according to control signal Ty fed from the control circuit 203 and forwards it to the terminals YE1 through YEM. The output signals of the switching device array 208 may be referred to as Vy1 through VyM.

Figures 17A, 17B, 17C, 17D, 17E, 17F, 17G, 17H:
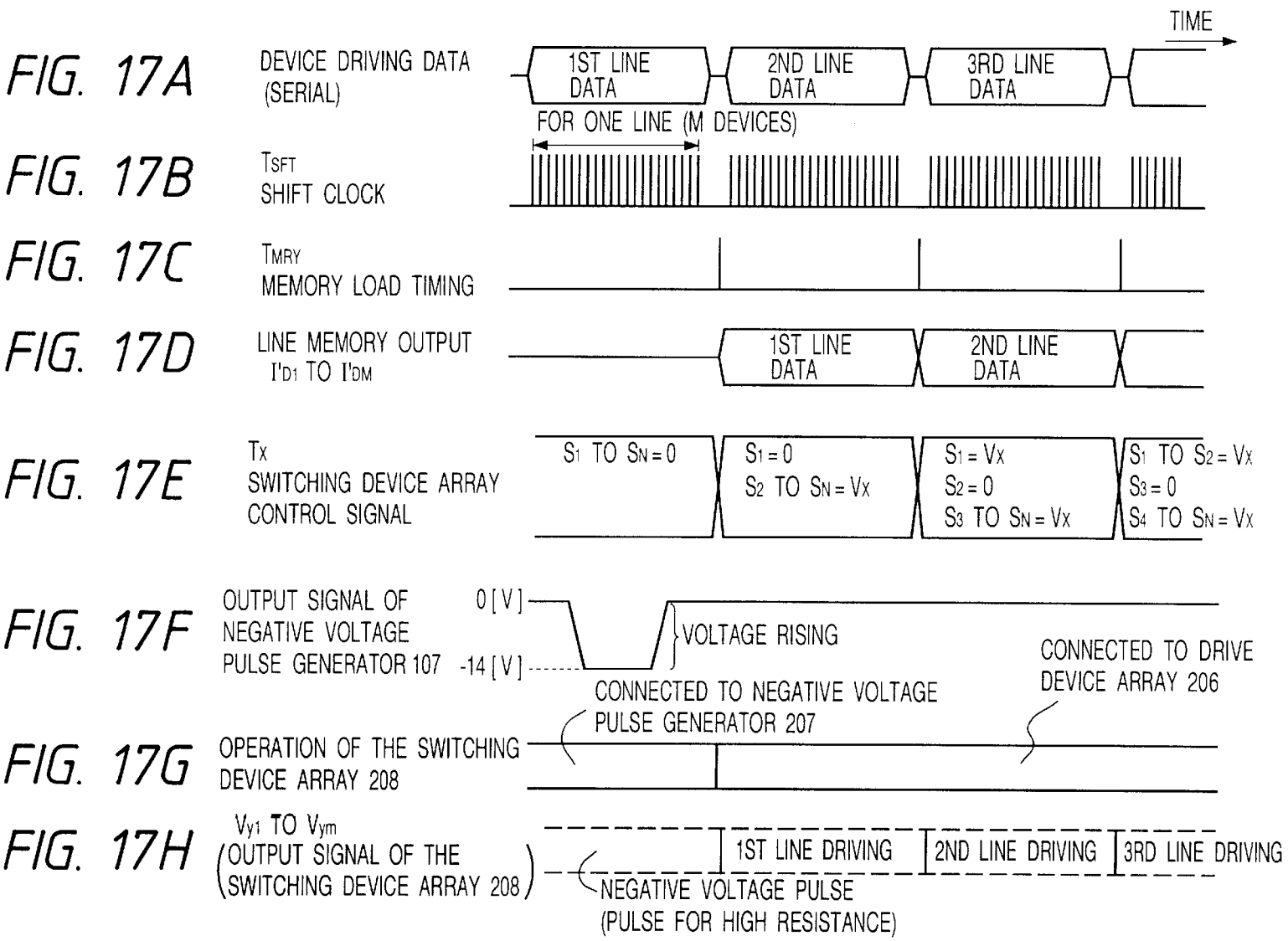
FIGS. 17A through 17H are timing charts for the operation of different components of the image-forming apparatus of the fourth embodiment.

The above described components of the circuit operate in a manner as described below by referring to the timing charts of FIGS. 17A through 17H. FIG. 17A shows that serial image data are sequentially fed to the shift register 204 of FIG. 15 on a line by line basis (and pixel by pixel basis for each line) in the order of the first line, the second line, the third line and so on from an external image data source.

In synchronism with the image data, the timing control circuit 203 transmits shift clock Tsft as shown in FIG. 17B to the shift register 204. Thus, as a set of serial image data is fed to the shift register for a line, it carries out a serial/parallel conversion for the line and the timing control circuit 203 synchronously produces a memory load timing signal Tmry as shown in FIG. 17C to the corresponding line memory 205.

In this way, the output signals ID1' through IDM' of the line memory 205 are sequentially processed for the image data of the first line, the image data of the second line and so on in synchronism with the memory load timing signal Tmry.

On the other hand, the timing control circuit 203 produces control signal Tscan to the switching device array 202 in order to proper drive the devices of the lines. This signal is illustrated in FIG. 17E. If S1=0 and S2 through SN=Vx, 0V (ground level) is fed to the switching device S1 and VE (V) is fed to each of the switching devices S2 through SN. As may be clear from FIG. 17E, S1 through SN are brought to 0V in the first place in order to bring all the surface conduction electron-emitting devices 104 into a high resistance state and, thereafter, the devices are scanned on a line by line basis.

FIG. 17F shows the output signal of the negative voltage pulse generator 207 that operates according to the control signal from the timing control circuit 203. As seen, a negative voltage pulse is generated corresponding to S1 through SN=0 in FIG. 17E.

FIG. 17G illustrates the operation of the switching device array 208. As shown, it forwards the output of the negative voltage pulse generator 207 to YE1 through YEM in the phase of S1 through SN=0 and that of the drive device array 206 to YE1 through YEM in all the remaining phase. Thus, switching device array 208 produces output signals Vy1 through VyM in a manner as described in FIG. 17H.

As described above, the operation of displaying a first image starts after applying a high resistance realizing pulse to all the surface conduction electron-emitting devices. In order to display images that are agreeable to the human eye, the image-forming apparatus should operate to produce images at a rate greater than 60 images/sec. Such operation can be easily realized for an NTSC television system by designing the timing control circuit 203 to operate for applying a high resistance realizing pulse in the vertical scanning phase of the television.

Embodiment 5

Figure 18:
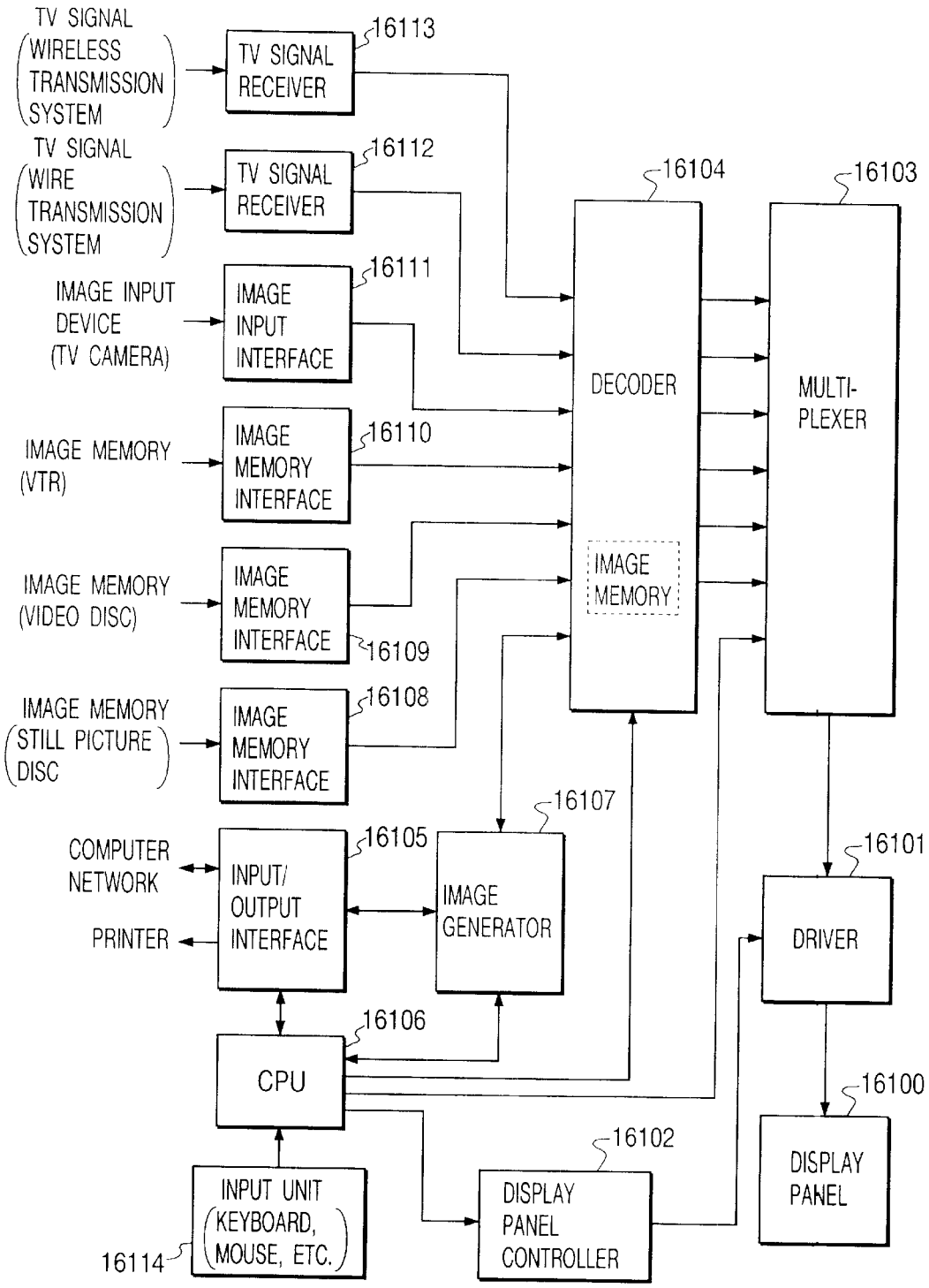
FIG. 18 is a block diagram of a fifth embodiment of the invention, which is an image-forming apparatus.

FIG. 18 is a block diagram of an image-forming apparatus realized by using an electron source comprising a large number of surface conduction electron-emitting devices and devised to provide visual information coming from a variety of sources of information including television transmission and other image sources.

In FIG. 18, there are shown a display panel 16100, a display panel drive circuit 16101, a display panel controller 16102, a multiplexer 16103, a decoder 16104, an input/output interface circuit 16105, a CPU 16106, an image generator 16107, image input memory interface circuits 16108, 16109 and 16110, an image input interface circuit 16111, TV signal reception circuits 16112 and 16113 and an input unit 16114.

If the display apparatus is used for receiving television signals that are constituted by video and audio signals, circuits, speakers and other devices are required for receiving, separating, reproducing, processing and storing audio signals along with the circuits shown in the drawing. However, such circuits and devices are omitted here in view of the scope of the present invention.

Now, the components of the apparatus will be described, following the flow of image signals therethrough.

Firstly, the TV signal reception circuit 16113 is a circuit for receiving TV image signals transmitted via a wireless transmission system using electromagnetic waves and/or spatial optical telecommunication networks.

The TV signal system to be received is not limited to a particular one and any system such as NTSC, PAL or SECAM may feasibly be used with it. It is particularly suited for TV signals involving a larger number of scanning lines typically of a high definition TV system such as the MUSE system because it can be used for a large display panel comprising a large number of pixels.

The TV signals received by the TV signal reception circuit 16113 are forwarded to the decoder 16104.

Secondly, the TV signal reception circuit 16112 is a circuit for receiving TV image signals transmitted via a wired transmission system using coaxial cables and/or optical fibers. Like the TV signal reception circuit 16113, the TV signal system to be used is not limited to a particular one and the TV signals received by the circuit are forwarded to the decoder 16104.

The image input interface circuit 16111 is a circuit for receiving image signals forwarded from an image input device such as a TV camera or an image pick-up scanner. It also forwards the received image signals to the decoder 16104.

The image input memory interface circuit 16110 is a circuit for retrieving image signals stored in a video tape recorder (hereinafter referred to as VTR) and the retrieved image signals are also forwarded to the decoder 16104.

The image input memory interface circuit 16109 is a circuit for retrieving image signals stored in a video disc and the retrieved image signals are also forwarded to the decoder 16104.

The image input memory interface circuit 16108 is a circuit for retrieving image signals stored in a device for storing still image data such as so-called still disc and the retrieved image signals are also forwarded to the decoder 16104.

The input/output interface circuit 16105 is a circuit for connecting the display apparatus and an external output signal source such as a computer, a computer network or a printer. It carries out input/output operations for image data and data on characters and graphics and, if appropriate, for control signals and numerical data between the CPU 16106 of the display apparatus and an external output signal source.

The image generation circuit 16107 is a circuit for generating image data to be displayed on the display screen on the basis of the image data and the data on characters and graphics input from an external output signal source via the input/output interface circuit 16105 or those coming from the CPU 16106. The circuit comprises reloadable memories for storing image data and data on characters and graphics, read-only memories for storing image patterns corresponding given character codes, a processor for processing image data and other circuit components necessary for the generation of screen images.

Image data generated by the image generation circuit 16107 for display are sent to the decoder 16104 and, if appropriate, they may also be sent to an external circuit such as a computer network or a printer via the input/output interface circuit 16105.

The CPU 16106 controls the display apparatus and carries out the operation of generating, selecting and editing images to be displayed on the display screen.

For example, the CPU 16106 sends control signals to the multiplexer 16103 and appropriately selects or combines signals for images to be displayed on the display screen. At the same time it generates control signals for the display panel controller 16102 and controls the operation of the display apparatus in terms of image display frequency, scanning method (e.g., interlaced scanning or non-interlaced scanning), the number of scanning lines per frame and so on. The CPU 16106 also sends out image data and data on characters and graphic directly to the image generation circuit 16107 and accesses external computers and memories via the input/output interface circuit 16105 to obtain external image data and data on characters and graphics.

The CPU 16106 may additionally be so designed as to participate other operations of the display apparatus including the operation of generating and processing data like the CPU of a personal computer or a word processor. The CPU 16106 may also be connected to an external computer network via the input/output interface circuit 16105 to carry out computations and other operations, cooperating therewith.

The input unit 16114 is used for forwarding the instructions, programs and data given to it by the operator to the CPU 16106. As a matter of fact, it may be selected from a variety of input devices such as keyboards, mice, joysticks, bar code readers and voice recognition devices as well as any combinations thereof.

The decoder 16104 is a circuit for converting various image signals input via said circuits 16107 through 16113 back into signals for three primary colors, luminance signals and I and Q signals. Preferably, the decoder 16104 comprises image memories as indicated by a dotted line in FIG. 18 for dealing with television signals such as those of the MUSE system that require image memories for signal conversion.

The provision of image memories additionally facilitates the display of still images as well as such operations as thinning out, interpolating, enlarging, reducing, synthesizing and editing frames to be optionally carried out by the decoder 16104 in cooperation with the image generation circuit 16107 and the CPU 16106.

The multiplexer 16103 is used to appropriately select images to be displayed on the display screen according to control signals given by the CPU 16106. In other words, the multiplexer 16103 selects certain converted image signals coming from the decoder 16104 and sends them to the drive circuit 16101. It can also divide the display screen in a plurality of frames to display different images simultaneously by switching from a set of image signals to a different set of image signals within the time period for displaying a single frame.

The display panel controller 16102 is a circuit for controlling the operation of the drive circuit 16101 according to control signals transmitted from the CPU 16106.

Among others, it operates to transmit signals to the drive circuit 16101 for controlling the sequence of operations of the power source (not shown) for driving the display panel 16100 in order to define the basic operation of the display panel. It also transmits signals to the drive circuit 16101 for controlling the image display frequency and the scanning method (e.g., interlaced scanning or non-interlaced scanning) in order to define the mode of driving the display panel 16100. If appropriate, it also transmits signals to the drive circuit 16101 for controlling the quality of the images to be displayed on the display screen in terms of luminance, contrast, color tone and sharpness.

The drive circuit 16101 is a circuit for generating drive signals to be applied to the display panel 16100. It operates according to image signals coming from said multiplexer 16103 and control signals coming from the display panel controller 16102.

A display apparatus according to the invention and having a configuration as described above and illustrated in FIG. 18 can display on the display panel 16100 various images given from a variety of image data sources. More specifically, image signals such as television image signals are converted back by the decoder 16104 and then selected by the multiplexer 16103 before sent to the drive circuit 16101. On the other hand, the display controller 16102 generates control signals for controlling the operation of the drive circuit 16101 according to the image signals for the images to be displayed on the display panel 16100. The drive circuit 16101 then applies drive signals to the display panel 16100 according to the image signals and the control signals. Thus, images are displayed on the display panel 16100. All the above described operations are controlled by the CPU 16106 in a coordinated manner.

The above described display apparatus can not only select and display particular images out of a number of images given to it but also carry out various image processing operations including those for enlarging, reducing, rotating, emphasizing edges of, thinning out, interpolating, changing colors of and modifying the aspect ratio of images and editing operations including those for synthesizing, erasing, connecting, replacing and inserting images as the image memories incorporated in the decoder 16104, the image generation circuit 16107 and the CPU 16106 participate such operations. Although not described with respect to the above embodiment, it is possible to provide it with additional circuits exclusively dedicated to audio signal processing and editing operations.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an OA apparatus such as a word processor, as a game machine and in many other ways.

It may be needless to say that FIG. 18 shows only an example of possible configuration of a display apparatus comprising a display panel provided with an electron source prepared by arranging a number of surface conduction electron-emitting devices and the present invention is not limited thereto.

For example, some of the circuit components of FIG. 18 may be omitted or additional components may be arranged there depending on the application. To the contrary, if a display apparatus according to the invention is used for visual telephone, it may be appropriately made to comprise additional components such as a television camera, a microphone, lighting equipment and transmission/reception circuits including a modem.

Since the display panel of the image forming apparatus of this example can be realized with a remarkably reduced depth, the entire apparatus can be made very flat. Additionally, since the display panel can provide very bright images and a wide viewing angle, it produces very exciting sensations in the viewer to make him or her feel as if he or she were really present in the scene.

As described above, according to the invention, the inutile electric current flowing through each of the surface conduction electron-emitting devices of an electron source incorporated in an image-forming apparatus that are not selected for displaying an image can be reduced to greatly save the power consumed by the electron source. Additionally, any unnecessary emission of electron beam and light that can adversely affect the image displaying operation of the apparatus can be effectively prevented. Such an electron source and therefore an image-forming apparatus incorporating such an electron source operate accurately and reliably.

What is claimed is:

1. An electron source comprising a plurality of electron-emitting devices having a pair of electrodes and an electroconductive thin film disposed between the electrodes and containing an electron emitting region and a drive means for driving said plurality of electron-emitting devices, to form an image through electrons emitted from the electron-emitting devices, wherein said drive means applies a voltage above a threshold level to the electrodes of selected ones of said plurality of electron-emitting devices according to an image signal to cause the selected electron-emitting devices to emit electrons and also a voltage pulse for bringing said plurality of electron-emitting devices into a temporary high resistance state, said voltage pulse having a polarity reverse to that of the voltage for causing electron emission and a voltage rising or falling rate to zero volt of greater than 10V/sec, said voltage pulse being applied in a period when said voltage above the threshold level is not applied.

2. An electron source according to claim 1, wherein the top plane of one of the device electrodes is higher than that of the other.

3. An electron source according to claim 1, wherein the electron-emitting devices are surface conduction electron-emitting devices.

4. An electron source comprising a plurality of electron-emitting devices having a pair of electrodes and an electroconductive thin film disposed between the electrodes and containing an electron emitting region and a drive means for driving said plurality of electron-emitting devices, wherein said drive means applies a voltage above a threshold level to the electrode of selected ones of said plurality of electron-emitting devices according to an image signal to cause the selected electron-emitting devices to emit electrons and also a voltage pulse for bringing said plurality of electron-emitting devices into a high resistance state, said voltage pulse having a polarity reverse to that of the voltage for causing electron emission and a voltage rising rate of greater than 10V/sec, said voltage pulse being applied in a period when said voltage above the threshold level is not applied, and wherein the voltage pulse for bringing the electron-emitting devices into a high resistance state has a wave height greater than the voltage where the device current becomes a local maximum.

5. An electron source according to claim 4, wherein the top plane of one of the device electrodes is higher than that of the other.

6. An electron source comprising a plurality of electron-emitting devices having a pair of electrodes and an electroconductive thin film disposed between the electrodes and containing an electron emitting region and a drive means for driving said plurality of electron-emitting devices, wherein said drive means applies a voltage above a threshold level to the electrodes of selected ones of said plurality of electron-emitting devices according to an image signal to cause the selected electron-emitting devices to emit electrons and also a voltage pulse for bringing said plurality of electron-emitting devices into a high resistance state, said voltage pulse having a polarity reverse to that of the voltage for causing electron emission and a voltage rising rate of greater than 10V/sec, said voltage pulse being applied in a period when said voltage above the threshold level is not applied, wherein the voltage pulse for bringing the electron-emitting devices into a high resistance state has a wave height greater than the voltage applied to the unselected electron-emitting devices, and wherein the electron-emitting devices are selectively driven by X-direction wirings and Y-direction wirings arranged in a matrix.

7. An electron source according to claim 1, wherein the top plane of one of the device electrodes is higher than that of the other.

8. An electron source according to any of claims 1–5, 6 or 7, wherein the electron-emitting devices are surface conduction electron-emitting devices.

9. An image forming apparatus comprising a plurality of electron-emitting devices having a pair of electrodes and an electroconductive thin film disposed between the electrodes and containing an electron emitting region, an image-forming member and a drive means for driving said plurality of electron-emitting devices to form an image on the image-forming member through electrons emitted from the electron-emitting devices, wherein said drive means applies a voltage above a threshold level to the electrodes of selected ones of said plurality of electron-emitting devices according to an image signal to cause the selected electron-emitting devices to emit electrons and also a voltage pulse for bringing said plurality of electron-emitting devices into a temporary high resistance state, said voltage pulse having a polarity reverse to that of the voltage for causing electron emission and a voltage rising or falling rate to zero volt of greater than 10V/sec, said voltage pulse being applied in a period when said voltage above the threshold level is not applied.

10. An image-forming apparatus according to claim 9, wherein the top plane of one of the device electrodes is higher than that of the other.

11. An image-forming apparatus according to claim 9 or 10, wherein the electron-emitting devices are surface conduction electron-emitting devices.

12. An image-forming apparatus comprising a plurality of electron-emitting devices having a pair of electrodes and an electroconductive thin film disposed between the electrodes and containing an electron emitting region, a drive means for driving said plurality of electron-emitting devices and an image-forming member, wherein:

said drive means applies a voltage above a threshold level to the electrodes of selected ones of said plurality of electron-emitting devices according to an image signal to cause the selected electron-emitting devices to emit electrons and also a voltage pulse for bringing said plurality of electron-emitting devices into a high resistance state, said voltage pulse having a polarity reverse to that of the voltage for causing electron emission and a voltage rising rate of greater than 10V/sec., said voltage pulse being applied in a period when said voltage above the threshold level is not applied, and wherein the image-forming member is arranged out of the areas irradiated by electron beams emitted when the voltage pulse for bringing into a high resistance state is applied.

13. An image-forming apparatus according to claim 12, wherein the image-forming member includes fluorescent bodies and the areas irradiated by electron beams emitted when the voltage pulse for bringing into a high resistance state is applied are blackened.

14. An image-forming apparatus comprising a plurality of electron-emitting devices having a pair of electrodes and an electroconductive thin film disposed between the electrodes and containing an electron emitting region, a drive means for driving said plurality of electron-emitting devices and an image-forming member, wherein:

said drive means applies a voltage above a threshold level to the electrodes of selected ones of said plurality of electron-emitting devices according to an image signal to cause the selected electron-emitting devices to emit electrons and also a voltage pulse for bringing said plurality of electron-emitting devices into a high resistance state, said voltage pulse having a polarity reverse to that of the voltage for causing electron emission and a voltage rising rate of greater than 10V/sec., and wherein the voltage pulse for bringing the electron-emitting devices into a high resistance state has a wave height greater than the voltage where the device current becomes a local maximum.

15. An image-forming apparatus according to claim 14, wherein the top plane of one of the device electrodes is higher than that of the other.

16. An image-forming apparatus according to claim 14, wherein the image-forming member is arranged out of the areas irradiated by electron beams emitted when the voltage pulse for bringing into a high resistance state is applied.

17. An image-forming apparatus according to claim 16, wherein the image-forming member includes fluorescent bodies and the areas irradiated by electron beams emitted when the voltage pulse for bringing into a high resistance state is applied are blackened.

18. An image-forming apparatus according to any of claims 14 through 17, wherein the electron-emitting devices are surface conduction electron-emitting devices.

19. An image-forming apparatus comprising a plurality of electron-emitting devices having a pair of electrodes and an electroconductive thin film disposed between the electrodes and containing an electron emitting region, a drive means for driving said plurality of electron-emitting devices and an image-forming member, wherein:

said drive means applies a voltage above a threshold level to the electrodes of selected ones of said plurality of electron-emitting devices according to an image signal to cause the selected electron-emitting devices to emit electrons and also a voltage pulse for bringing said plurality of electron-emitting devices into a high resistance state, said voltage pulse having a polarity reverse to that of the voltage for causing electron emission and a voltage rising rate of greater than 10V/sec., said voltage pulse being applied in a period when said voltage above the threshold level is not applied, and wherein the voltage pulse for bringing the electron-emitting devices into a high resistance state has a wave height greater than the voltage applied to the unselected electron-emitting devices, and wherein the electron-emitting devices are selectively driven by X-direction wirings and Y-direction wirings arranged in a matrix.

20. An image-forming apparatus according to claim 19, wherein the top plane of one of the device electrodes is higher than that of the other.

21. An image-forming apparatus according to claim 19, wherein the image-forming member is arranged out of the areas irradiated by electron beams emitted when the voltage pulse for bringing into a high resistance state is applied.

22. An image-forming apparatus according to claim 21, wherein the image-forming member includes fluorescent bodies and the areas irradiated by electron beams emitted when the voltage pulse for bringing into a high resistance state is applied are blackened.

23. An image-forming apparatus according to any of claims 19 through 22, wherein the electron-emitting devices are surface conduction electron-emitting devices.

24. An image forming apparatus comprising a plurality of electron-emitting devices having a pair of electrodes and an electroconductive thin film disposed between the electrodes and containing an electron emitting region, a drive means for driving said plurality of electron-emitting devices and an image-forming member, wherein:

said drive means applies a voltage above a threshold level to the electrodes of selected ones of said plurality of electron-emitting devices according to an image signal to cause the selected electron-emitting devices to emit electrons and also a voltage pulse for bringing said plurality of electron-emitting devices into a high resis tance state, said voltage pulse having a polarity reverse to that of the voltage for causing electron emission and a voltage rising rate of greater than 10V/sec., said voltage pulse being applied in a period when said voltage above the threshold level is not applied, wherein the image-forming member is arranged out of the areas irradiated by electron beams emitted when the voltage pulse for bringing into a high resistance state is applied, and wherein the electron-emitting devices are surface conduction electron-emitting devices.

25. An image-forming apparatus according to claim 24, wherein the image-forming member includes fluorescent bodies and the areas irradiated by electron beams emitted when the voltage pulse for bringing into a high resistance state is applied are blackened.

* * * * *

UNITED STATES PATENT AND TRADEMARK OFFICE

CERTIFICATE OF CORRECTION

PATENT NO. : 6,473,063 B1 
DATED : October 29, 2002
INVENTOR(S) : Hidetoshi Suzuki et al.

It is certified that error appears in the above-identified patent and that said Letters Patent is hereby corrected as shown below:

Title page,
Item [56], FOREIGN PATENT DOCUMENTS,
"62186649 2/1989" should read -- 62-186649 2/1989 --.

Column 2,
Line 21, "resion" should read -- region --; and
Lines 39 and 49, "above described" should read -- above-described --.

Column 4,
Line 51, "is" should read -- is to --.

Column 5,
Line 55, "how" should read -- showing how --.

Column 8,
Lines 18 and 19, "hundreds" should read -- hundreds of --.

Column 10,
Line 61, "an" should read -- a --.

Column 14,
Line 18, "is" should read -- may --.

Column 15,
Line 26, "sufficiently" should read -- sufficient --.

Column 17,
Line 32, "beams" should read -- beam --.

Column 18,
Line 9, "gets" should read -- get --.

Column 19,
Line 51, "above described" should read -- above-described --.

Column 23,
Lines 8 and 10, "above described" should read -- above-described --; and
Line 19, "such" should read -- in such --.

UNITED STATES PATENT AND TRADEMARK OFFICE

CERTIFICATE OF CORRECTION

PATENT NO. : 6,473,063 B1
DATED : October 29, 2002
INVENTOR(S) : Hidetoshi Suzuki et al.

It is certified that error appears in the above-identified patent and that said Letters Patent is hereby corrected as shown below:

Column 25,
Line 1, "claims 1-5, 6 or" should read -- claims 1 to 7, --; and
Line 2, "7," should be deleted.

Column 26,
Line 67, "resis" should read -- resis- --.

Signed and Sealed this

Eighteenth Day of November, 2003

JAMES E. ROGAN
*Director of the United States Patent and Trademark Office*